US011587572B2

(12) United States Patent
Wang et al.

(10) Patent No.: US 11,587,572 B2
(45) Date of Patent: Feb. 21, 2023

(54) STEREO SIGNAL ENCODING METHOD AND APPARATUS

(71) Applicant: Huawei Technologies Co., Ltd., Shenzhen (CN)

(72) Inventors: Bin Wang, Beijing (CN); Zexin Liu, Beijing (CN); Haiting Li, Beijing (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 31 days.

(21) Appl. No.: 17/107,004

(22) Filed: Nov. 30, 2020

(65) Prior Publication Data

US 2021/0082443 A1 Mar. 18, 2021

Related U.S. Application Data

(63) Continuation of application No. PCT/CN2019/089099, filed on May 29, 2019.

(30) Foreign Application Priority Data

May 31, 2018 (CN) ..... 201810549268.9

(51) Int. Cl.
*G10L 19/008* (2013.01)
*G10L 19/22* (2013.01)

(52) U.S. Cl.
CPC ..... *G10L 19/008* (2013.01)

(58) Field of Classification Search
CPC ..... G10L 19/008; G10L 19/005; G10L 19/04; G10L 19/002; G10L 19/00; G10L 19/06;
(Continued)

(56) References Cited

U.S. PATENT DOCUMENTS

2011/0085670 A1 4/2011 Pang et al.
2011/0320212 A1* 12/2011 Tsujino ..... G10L 19/002 704/500

(Continued)

FOREIGN PATENT DOCUMENTS

CN 101350197 A 1/2009
CN 101594186 A 12/2009

(Continued)

OTHER PUBLICATIONS

Elfitri, I., et al., "Experimental Study on Improved Parametric Stereo for Bit Rate Scalable Audio Coding," 2014 6th International Conference on Information Technology and Electrical Engineering (ICITEE), XP032720258, Yogyakarta, Indonesia, 6 pages.

*Primary Examiner* — Leshui Zhang
(74) *Attorney, Agent, or Firm* — Conley Rose, P.C.

(57) ABSTRACT

A stereo signal encoding method includes obtaining indication information of an encoding mode of a residual signal of a current frame, where the indication information includes at least one of an encoding status of a residual signal of a previous frame, a value of an updating manner flag for a long-term smooth parameter of the current frame, or a value of a status change parameter of the current frame relative to a stereo signal of the previous frame, and determining the encoding mode of the residual signal of the current frame based on the indication information of the encoding mode of the residual signal of the current frame, where the encoding mode indicates whether to encode the residual signal of the current frame.

20 Claims, 11 Drawing Sheets

(58) Field of Classification Search
CPC ..... G10L 19/032; G10L 19/18; G10L 19/22; G10L 19/0208; G10L 19/0017; G10L 19/26; H04S 3/00
USPC ..... 704/500–504; 381/1–23
See application file for complete search history.

(56) References Cited

U.S. PATENT DOCUMENTS

| | | | | |
|---|---|---|---|---|
| 2012/0002818 | A1 | 1/2012 | Heiko et al. | |
| 2013/0142340 | A1 | 6/2013 | Sehlstrom et al. | |
| 2013/0289981 | A1* | 10/2013 | Ragot ..... | G10L 19/022 704/219 |
| 2016/0064004 | A1* | 3/2016 | Laaksonen ..... | G10L 19/008 704/500 |
| 2016/0142845 | A1 | 5/2016 | Dick et al. | |
| 2019/0172474 | A1 | 6/2019 | Liu et al. | |
| 2021/0082445 | A1 | 3/2021 | Wang et al. | |

FOREIGN PATENT DOCUMENTS

| | | | | | |
|---|---|---|---|---|---|
| CN | 102165519 | A | | 8/2011 | |
| CN | 103098131 | A | | 5/2013 | |
| CN | 104170007 | A | | 11/2014 | |
| CN | 105556596 | A | | 5/2016 | |
| CN | 107731238 | A | | 2/2018 | |
| JP | 2003330497 | A | * | 11/2003 | ..... G10L 19/02 |
| JP | 2003330497 | A | | 11/2003 | |
| JP | 2004325633 | A | | 11/2004 | |
| JP | 2012521012 | A | | 9/2012 | |
| WO | 2017049397 | A1 | | 3/2017 | |
| WO | 2019227991 | A1 | | 12/2019 | |

* cited by examiner

STEREO SIGNAL ENCODING METHOD AND APPARATUS

CROSS-REFERENCE TO RELATED DISCLOSURES

This application is a continuation of International Patent Application No. PCT/CN2019/089099 filed on May 29, 2019, which claims priority to Chinese Patent Application No. 201810549268.9 filed on May 31, 2018. The disclosures of the aforementioned applications are hereby incorporated by reference in their entireties.

TECHNICAL FIELD

This disclosure relates to the field of audio signal encoding and decoding technologies, and in particular, to a stereo signal encoding method and an apparatus.

BACKGROUND

As quality of life is improved, a requirement for high-quality audio is constantly increased. Compared with mono audio, stereo audio has a sense of orientation and a sense of distribution for each acoustic source, and can improve clarity, intelligibility, and a sense of presence of information. Therefore, the stereo audio is highly favored by people.

Parameter stereo encoding and decoding technologies are usually used to encode a stereo signal. The parameter stereo encoding and decoding technologies are common stereo encoding and decoding technologies in which a stereo signal is transformed to a spatial sensing parameter and a channel of signal, or a stereo signal is transformed to a spatial sensing parameter and two channels of signals, to implement compression processing on a multi-channel signal.

However, in an existing parameter stereo encoding algorithm, generally, only a stereo parameter and a downmixed signal are encoded, but a residual signal is not encoded, or a downmixed signal is encoded, and residual signals of corresponding sub-bands in a preset bandwidth range are uniformly encoded. If the residual signal is not encoded, a spatial sense of the decoded stereo signal is relatively poor, and audio-video stability is greatly how accurately a stereo parameter is extracted. However, if the residual signals of the corresponding sub-bands in the preset bandwidth range are uniformly encoded, some signals with more abundant high-frequency information are generated. Because a sufficient quantity of bits cannot be allocated to encode a downmixed signal, high-frequency distortion of a decoded stereo signal becomes large, which reduces overall quality of the encoding.

SUMMARY

This disclosure provides a stereo signal encoding method and apparatus, to better improve encoding quality of a stereo signal.

According to a first aspect, a stereo signal encoding method is provided. The method includes obtaining indication information of an encoding mode of a residual signal of a current frame, where the indication information includes at least one of an encoding status of a residual signal of a previous frame of the current frame, a value of a updating manner flag for a long-term smooth parameter of a stereo signal of the current frame, or a value of a status change parameter of a stereo signal of the current frame relative to a stereo signal of the previous frame, and determining the encoding mode of the residual signal of the current frame based on the obtained indication information of the encoding mode of the residual signal of the current frame, where the encoding mode indicates whether to encode the residual signal of the current frame.

In this embodiment of this disclosure, because some factors of signals of several preceding frames of the current frame, such as the encoding status, the value of the updating manner flag for the long-term smooth parameter, and the value of the status change parameter are related to the encoding mode of the residual signal of the current frame, the encoding mode that is of the residual signal of the current frame and that is determined based on at least one of encoding statuses of the signals of the several preceding frames, the value of the updating manner flag for the long-term smooth parameter, or the value of the status change parameter has relatively high accuracy, thereby better improving encoding quality of a stereo signal.

In some possible implementations, the encoding status of the residual signal of the previous frame of the current frame indicates at least one of the following cases: a quantity of consecutive frames whose residual signals are encoded before the current frame, a quantity of consecutive frames whose residual signals are not encoded before the current frame, or encoding modes of residual signals of N preceding frames of the current frame, where the N preceding frames of the current frame are consecutive in time domain, the N preceding frames of the current frame include a previous frame closely adjacent to the current frame, and N is a positive integer.

In some possible implementations, the value of the status change parameter includes a ratio of energy of the stereo signal of the current frame to energy of the stereo signal of M preceding frames of the current frame, where the M preceding frames of the current frame are consecutive in time domain, the M preceding frames of the current frame include the previous frame closely adjacent to the current frame, and M is a positive integer, or a ratio of an amplitude of the stereo signal of the current frame to an amplitude of the stereo signal of S preceding frames of the current frame, where the S preceding frames of the current frame are consecutive in time domain, the S preceding frames of the current frame include the previous frame closely adjacent to the current frame, and S is a positive integer.

In some possible implementations, before determining the encoding mode of the residual signal of the current frame based on the obtained indication information of the encoding mode of the residual signal of the current frame, the method further includes determining an initial encoding mode of the residual signal of the current frame, and determining the encoding mode of the residual signal of the current frame based on the obtained indication information of the encoding mode of the residual signal of the current frame includes determining the encoding mode of the residual signal of the current frame based on the indication information of the encoding mode of the residual signal of the current frame and the initial encoding mode of the residual signal of the current frame.

In the foregoing technical solution, the initial encoding mode of the residual signal of the current frame is first determined, and then the encoding mode is determined based on the initial encoding mode. Because the initial encoding mode of the residual signal of the current frame is related to the encoding mode of the residual signal of the current frame, the encoding mode determined based on the initial encoding mode has relatively high accuracy, thereby better improving encoding quality of a stereo signal.

In some possible implementations, the indication information of the encoding mode of the residual signal of the current frame includes the encoding status of the residual signal of the previous frame of the current frame, and the encoding status of the residual signal of the previous frame of the current frame indicates the encoding modes of the residual signals of the N preceding frames of the current frame, and determining the encoding mode of the residual signal of the current frame based on the indication information of the encoding mode of the residual signal of the current frame and the initial encoding mode of the residual signal of the current frame includes, if the initial encoding mode is the same as an encoding mode of a residual signal of the previous frame closely adjacent to the current frame, determining that the encoding mode of the residual signal of the current frame is the initial encoding mode.

In some possible implementations, the indication information of the encoding mode of the residual signal of the current frame includes the encoding status of the residual signal of the previous frame of the current frame and/or the value of the updating manner flag for the long-term smooth parameter, and the encoding status of the residual signal of the previous frame of the current frame indicates the quantity of consecutive frames whose residual signals are encoded before the current frame, and the encoding modes of the residual signals of the N preceding frames of the current frame, and determining the encoding mode of the residual signal of the current frame based on the indication information of the encoding mode of the residual signal of the current frame and the initial encoding mode of the residual signal of the current frame includes, if the initial encoding mode is different from an encoding mode of a residual signal of the previous frame closely adjacent to the current frame, and the encoding mode of the residual signal of the previous frame indicates to encode the residual signal of the previous frame, when a first condition is met, determining that the encoding mode of the residual signal of the current frame is the encoding mode of the residual signal of the previous frame, where the first condition includes that the quantity of consecutive frames whose residual signals are encoded before the current frame is less than a first threshold.

In the foregoing technical solution, because the residual signal of the current frame and the residual signal of the previous frame are consecutive in terms of time, it is first determined whether the encoding mode of the residual signal of the previous frame is the same as the initial encoding mode of the residual signal of the current frame, and then the encoding mode that is of the residual signal of the current frame and that is further determined based on a result of the determining has relatively high accuracy. In addition, the first threshold is set, the quantity of consecutive frames whose residual signals are encoded before the current frame is compared with the first threshold, and the encoding mode of the residual signal of the current frame is determined based on a comparison result. Therefore, the following case is avoided: when the quantity of consecutive frames whose residual signals are encoded before the current frame meets any condition, the encoding mode of the residual signal of the current frame is determined to indicate to encode or not to encode the residual signal. In this way, the determined encoding mode of the residual signal of the current frame has relatively high accuracy and is close to an actual encoding mode of the residual signal of the current frame.

In some possible implementations, the first condition further includes that the value of the updating manner flag for the long-term smooth parameter is 0, and that the encoding mode of the residual signal of the previous frame is not modified.

In some possible implementations, the method further includes, if the first condition is not met, determining that the encoding mode of the residual signal of the current frame is the initial encoding mode.

In some possible implementations, the indication information of the encoding mode of the residual signal of the current frame includes the encoding status of the residual signal of the previous frame of the current frame and/or the value of the status change parameter, and the encoding status of the residual signal of the previous frame of the current frame indicates the quantity of consecutive frames whose residual signals are not encoded before the current frame, and the encoding modes of the residual signals of the N preceding frames of the current frame, and determining the encoding mode of the residual signal of the current frame based on the indication information of the encoding mode of the residual signal of the current frame and the initial encoding mode of the residual signal of the current frame includes, if the initial encoding mode is different from an encoding mode of a residual signal of the previous frame closely adjacent to the current frame, and the encoding mode of the residual signal of the previous frame indicates not to encode the residual signal of the previous frame, when a second condition is met, determining that the encoding mode of the residual signal of the current frame is the encoding mode of the residual signal of the previous frame, where the second condition includes that the quantity of consecutive frames whose residual signals are not encoded before the current frame is less than a first threshold.

In some possible implementations, the second condition further includes that the value of the status change parameter is greater than or equal to a second threshold, and less than or equal to a third threshold.

In some possible implementations, the method further includes, if the second condition is not met, determining that the encoding mode of the residual signal of the current frame is the initial encoding mode.

In some possible implementations, the method further includes modifying the encoding mode of the residual signal of the current frame based on the indication information of the encoding mode of the residual signal of the current frame.

In the foregoing technical solution, after the encoding mode of the residual signal of the current frame is determined, if a specified condition is met, the encoding mode of the residual signal of the current frame may be modified such that the finally determined encoding mode of the current frame is more accurate, thereby further improving encoding quality of a stereo signal.

In some possible implementations, the indication information of the encoding mode of the residual signal of the current frame includes the encoding status of the residual signal of the previous frame of the current frame, and the encoding status of the residual signal of the previous frame of the current frame indicates the encoding modes of the residual signals of the N preceding frames of the current frame, and the modifying the encoding mode of the residual signal of the current frame based on the indication information of the encoding mode of the residual signal of the current frame includes, if the encoding mode of the residual signal of the current frame is different from the encoding mode of the residual signal of the previous frame closely adjacent to the current frame, and the encoding mode of the residual signal of the previous frame is not modified, determining that the encoding mode of the residual signal of the current frame indicates to encode the residual signal of the current frame.

In some possible implementations, determining an initial encoding mode of the residual signal of the current frame includes determining the initial encoding mode based on energy of a downmixed signal of the current frame and energy of the residual signal of the current frame.

In the foregoing technical solution, the initial encoding mode is determined based on the energy of the downmixed signal in a preset bandwidth range and the energy of the residual signal in the preset bandwidth range. In this way, the following problem can be avoided. Only a downmixed signal is encoded when an encoding rate is low, or residual signals of corresponding sub-bands in a preset bandwidth range are uniformly encoded. Therefore, when a spatial sense and audio-video stability of a decoded stereo signal are ensured, high-frequency distortion of the decoded stereo signal can be reduced, thereby improving overall encoding quality.

According to a second aspect, an encoding apparatus is provided. The apparatus includes an obtaining module configured to obtain indication information of an encoding mode of a residual signal of a current frame, where the indication information includes at least one of an encoding status of a residual signal of a previous frame of the current frame, a value of a updating manner flag for a long-term smooth parameter of a stereo signal of the current frame, or a value of a status change parameter of a stereo signal of the current frame relative to a stereo signal of the previous frame, and a determining module configured to determine the encoding mode of the residual signal of the current frame based on the indication information that is of the encoding mode of the residual signal of the current frame and that is obtained by the obtaining module, where the encoding mode indicates whether to encode the residual signal of the current frame.

In some possible implementations, the encoding status that is of the residual signal of the previous frame and that is obtained by the obtaining module indicates at least one of the following cases a quantity of consecutive frames whose residual signals are encoded before the current frame, a quantity of consecutive frames whose residual signals are not encoded before the current frame, or encoding modes of residual signals of N preceding frames of the current frame, where the N preceding frames of the current frame are consecutive in time domain, the N preceding frames of the current frame include a previous frame closely adjacent to the current frame, and N is a positive integer.

In some possible implementations, the value of the status change parameter obtained by the obtaining module includes a ratio of energy of the stereo signal of the current frame to energy of the stereo signal of M preceding frames of the current frame, where the M preceding frames of the current frame are consecutive in time domain, the M preceding frames of the current frame include the previous frame closely adjacent to the current frame, and M is a positive integer, or a ratio of an amplitude of the stereo signal of the current frame to an amplitude of the stereo signal of S preceding frames of the current frame, where the S preceding frames of the current frame are consecutive in time domain, the S preceding frames of the current frame include the previous frame closely adjacent to the current frame, and S is a positive integer.

In some possible implementations, the determining module is further configured to determine an initial encoding mode of the residual signal of the current frame.

In some possible implementations, the determining module is further configured to determine the encoding mode of the residual signal of the current frame based on the indication information of the encoding mode of the residual signal of the current frame and the initial encoding mode of the residual signal of the current frame.

In some possible implementations, the indication information that is of the encoding mode of the residual signal of the current frame and that is obtained by the obtaining module includes the encoding status of the residual signal of the previous frame of the current frame, and the encoding status of the residual signal of the previous frame of the current frame indicates the encoding modes of the residual signals of the N preceding frames of the current frame, and the determining module is further configured to, if the initial encoding mode is the same as an encoding mode of a residual signal of the previous frame closely adjacent to the current frame, determine that the encoding mode of the residual signal of the current frame is the initial encoding mode.

In some possible implementations, the indication information that is of the encoding mode of the residual signal of the current frame and that is obtained by the obtaining module includes the encoding status of the residual signal of the previous frame of the current frame and/or the value of the updating manner flag for the long-term smooth parameter, and the encoding status of the residual signal of the previous frame of the current frame indicates the quantity of consecutive frames whose residual signals are encoded before the current frame, and the encoding modes of the residual signals of the N preceding frames of the current frame, and the determining module is further configured to, if the initial encoding mode is different from an encoding mode of a residual signal of the previous frame closely adjacent to the current frame, and the encoding mode of the residual signal of the previous frame indicates to encode the residual signal of the previous frame, when a first condition is met, determine that the encoding mode of the residual signal of the current frame is the encoding mode of the residual signal of the previous frame, where the first condition includes that the quantity of consecutive frames whose residual signals are encoded before the current frame is less than a first threshold.

In some possible implementations, the first condition further includes that the value of the updating manner flag for the long-term smooth parameter is 0, and that the encoding mode of the residual signal of the previous frame is not modified.

In some possible implementations, the determining module is further configured to, if the first condition is not met, determine that the encoding mode of the residual signal of the current frame is the initial encoding mode.

In some possible implementations, the indication information that is of the encoding mode of the residual signal of the current frame and that is obtained by the obtaining module includes the encoding status of the residual signal of the previous frame of the current frame and/or the value of the status change parameter, and the encoding status of the residual signal of the previous frame of the current frame indicates the quantity of consecutive frames whose residual signals are not encoded before the current frame, and the encoding modes of the residual signals of the N preceding frames of the current frame, and the determining module is further configured to, if the initial encoding mode is different from an encoding mode of a residual signal of the previous frame closely adjacent to the current frame, and the encoding mode of the residual signal of the previous frame indicates not to encode the residual signal of the previous frame, when a second condition is met, determine that the encoding mode of the residual signal of the current frame is the encoding mode of the residual signal of the previous frame, where the second condition includes that the quantity of consecutive frames whose residual signals are not encoded before the current frame is less than a first threshold.

In some possible implementations, the second condition further includes that the value of the status change parameter is greater than or equal to a second threshold, and less than or equal to a third threshold.

In some possible implementations, the determining module is further configured to, if the second condition is not met, determine that the encoding mode of the residual signal of the current frame is the initial encoding mode.

In some possible implementations, the apparatus further includes a modification module configured to modify the encoding mode of the residual signal of the current frame based on the indication information of the encoding mode of the residual signal of the current frame.

In some possible implementations, the indication information that is of the encoding mode of the residual signal of the current frame and that is obtained by the obtaining module includes the encoding status of the residual signal of the previous frame of the current frame, and the encoding status of the residual signal of the previous frame of the current frame indicates the encoding modes of the residual signals of the N preceding frames of the current frame, and the modification module is further configured to, if the encoding mode of the residual signal of the current frame is different from the encoding mode of the residual signal of the previous frame closely adjacent to the current frame, and the encoding mode of the residual signal of the previous frame is not modified, determine that the encoding mode of the residual signal of the current frame indicates to encode the residual signal of the current frame.

In some possible implementations, the determining module is further configured to determine the initial encoding mode based on energy of a downmixed signal of the current frame and energy of the residual signal of the current frame.

According to a third aspect, an encoding apparatus is provided. The encoding apparatus includes a processor configured to implement functions in the method described in the first aspect. The encoding apparatus may further include a memory configured to store a program instruction and data. The memory is coupled to the processor. The processor may invoke and execute the program instruction stored in the memory, to implement the method in the first aspect or any implementation of the first aspect.

According to a fourth aspect, a computer-readable storage medium is provided. The computer-readable storage medium stores a program instruction. When the program instruction is read and executed by one or more processors, the method in the first aspect or any implementation of the first aspect can be implemented.

According to a fifth aspect, a chip is provided. The chip includes a processor and a communications interface. The communications interface is configured to communicate with an external component, and the processor is configured to perform the method in the first aspect or any possible implementation of the first aspect.

Optionally, the chip may further include a memory. The memory stores an instruction. The processor is configured to execute the instruction stored in the memory. When executing the instruction, the processor is configured to perform the method in the first aspect or any possible implementation of the first aspect.

Optionally, the chip is integrated into a terminal device or a network device.

DESCRIPTION OF EMBODIMENTS

The following describes technical solutions of this disclosure with reference to accompanying drawings.

Figure 1A:
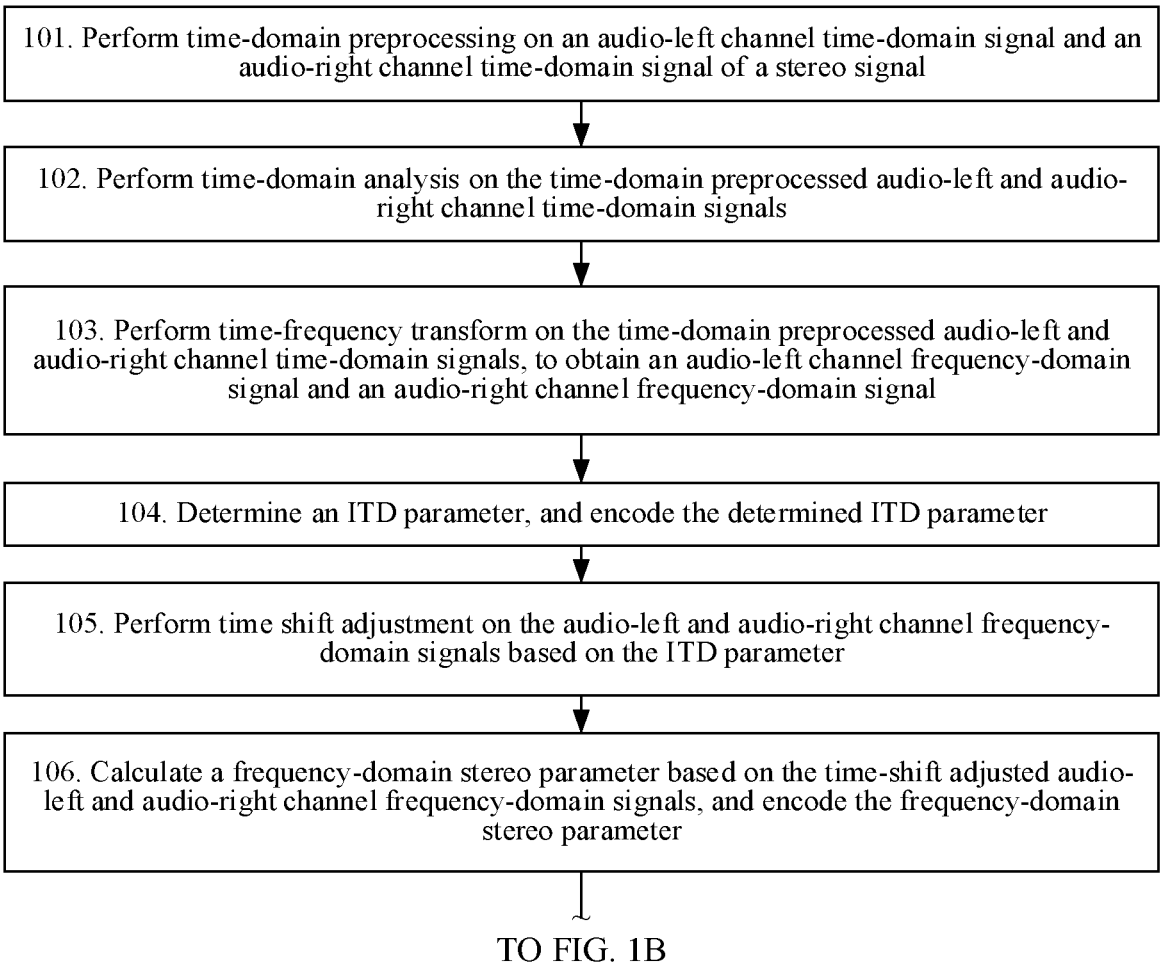
FIG. 1A and FIG. 1B are a schematic flowchart of a stereo signal encoding method.
Figure 1B:
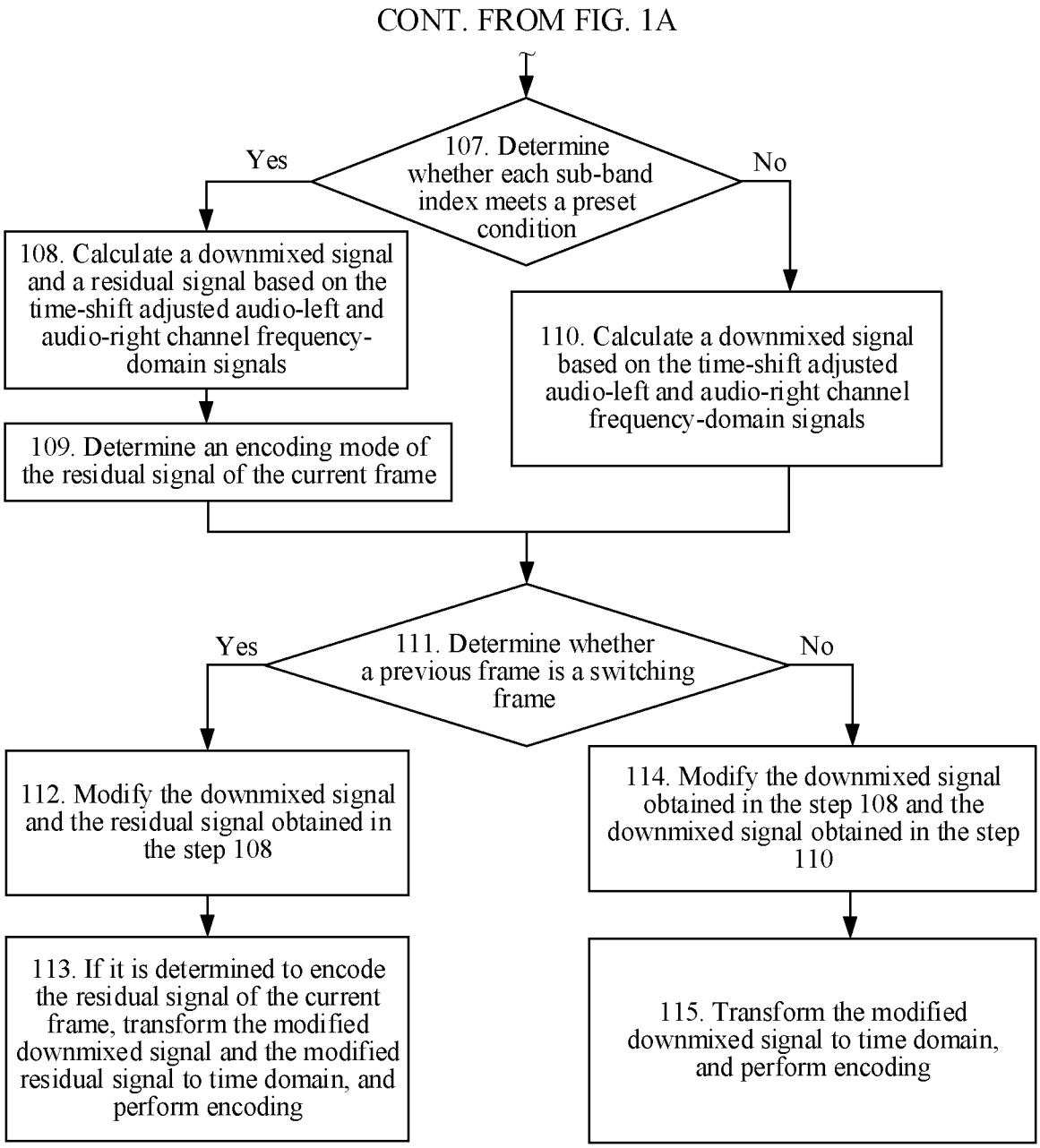

For ease of understanding a method in the embodiments of this disclosure, the following first describes an entire encoding process of a stereo signal encoding method with reference to FIG. 1A and FIG. 1B.

It should be understood that a stereo signal in the embodiments of this disclosure may be an original stereo signal, or may be a stereo signal consisting of two channels of signals included in a multi-channel signal, or may be a stereo signal consisting of two channels of signals that are jointly generated based on a plurality of channels of signals included in a multi-channel signal. This is not limited in this disclosure.

For ease of description, the embodiments of this disclosure are described using an example of wideband stereo encoding with an encoding rate of 26 kilobits per second (kbps). However, this disclosure is not limited thereto. It should be understood that the embodiments of this disclosure may also be applied to ultra-wideband stereo encoding or encoding with another rate.

FIG. 1A and FIG. 1B are a schematic flowchart of a stereo signal encoding method. The encoding method includes the following steps.

101. Perform time-domain preprocessing on an audio-left channel time-domain signal and an audio-right channel time-domain signal of a stereo signal.

In this embodiment of this disclosure, the stereo signal includes the audio-left channel signal and the audio-right channel signal.

Generally, the stereo signal may be divided into frames, and the time-domain preprocessing may be performed on the audio-left channel time-domain signal and the audio-right channel time-domain signal of the stereo signal after the frame division.

For example, a sampling frequency of the stereo signal is 16 kilohertz (kHz), and each frame of signal is 20 milliseconds (ms). It is assumed that a frame length is N. In this case, N=320. That is, the frame length is 320 sampling points.

It should be understood that an audio-left channel time-domain signal of a current frame may be represented as $x_L(n)$, and an audio-right channel time-domain signal of the current frame may be represented as $x_R(n)$. Herein, n is a sequence of sampling points, and n=0, 1, . . . , N−1.

Optionally, performing the time-domain preprocessing on the audio-left channel time-domain signal and the audio-right channel time-domain signal of the stereo signal may include separately performing high-pass filtering processing on the audio-left channel time-domain signal and the audio-right channel time-domain signal of the current frame, to obtain the time-domain preprocessed audio-left channel time-domain signal of the current frame and the time-domain preprocessed audio-right channel time-domain signal of the current frame.

It should be understood that the time-domain preprocessed audio-left channel time-domain signal $x_{L_HP}(n)$ of the current frame and the time-domain preprocessed audio-right channel time-domain signal $x_{R_HP}(n)$ of the current frame may also be referred to as time-domain preprocessed audio-left and audio-right channel time-domain signals of the current frame.

Optionally, the high-pass filtering processing may include but is not limited to using an infinite impulse response (IIR) filter, a finite impulse response (FIP) filter, and the like.

Optionally, a cut-off frequency of the IIR filter may be 20 Hz.

For example, a transfer function of the IIR filter whose cut-off frequency is 20 KHz and that corresponds to the stereo signal whose sampling frequency is 16 KHz may be as follows:

$$H_{20\ Hz}(z) = \frac{b_0 + b_1 z^{-1} + b_2 z^{-2}}{1 + a_1 z^{-1}\ a_2 z^{-2}}. \quad (1)$$

Herein, $b_0$=0.994461788958195, $b_1$=−1.988923577916390, $b_2$=0.994461788958195, $a_1$=1.988892905899653, and $a_2$=−0.988954249933127.

A corresponding time-domain filter is as follows:

$$x_{L_HP}(n)=b_0*x_L(n)+b_1*x_L(n-1)+b_2*x_L(n-2)-a_1*x_{L_HP}(n-1)-a_2*x_{L_HP}(n-2). \quad (2)$$

It should be understood that step 102, step 103, or step 104 may be performed after the step 101.

102. Perform time-domain analysis on the time-domain preprocessed audio-left and audio-right channel time-domain signals.

Optionally, the time-domain analysis may include transient detection.

The transient detection may be separately performing energy detection on the time-domain preprocessed audio-left and audio-right channel time-domain signals of the current frame, for example, detecting whether a sudden energy change occurs in the current frame.

For example, energy of a time-domain preprocessed audio-left channel time-domain signal of a previous frame is $E_{pre_L}$, and energy of the time-domain preprocessed audio-left channel time-domain signal of the current frame is $E_{cur_L}$. The transient detection may be performed based on an absolute value of a difference between $E_{cur_L}$ and $E_{pre_L}$. Similarly, the transient detection may be performed on the time-domain preprocessed audio-right channel time-domain signal of the current frame.

Optionally, the time-domain analysis may further include time-domain inter-channel time difference (ITD) parameter determining, time domain delay alignment processing, frequency band extension preprocessing, and the like.

103. Perform time-frequency transform on the time-domain preprocessed audio-left and audio-right channel time-domain signals, to obtain an audio-left channel frequency-domain signal and an audio-right channel frequency-domain signal.

Optionally, there may be many types of time-frequency transform. This is not limited in this embodiment of this disclosure. For example, the time-frequency transform may be discrete Fourier transform (DFT), fast Fourier transform (FFT), discrete cosine transform (DCT), modified DCT (MDCT), or the like.

For ease of description, description is provided using an example in which the time-frequency transform is the DFT. Further, the DFT may be performed on the time-domain preprocessed audio-left channel time-domain signal, to obtain the audio-left channel frequency-domain signal, and the DFT may be performed on the time-domain preprocessed audio-right channel time-domain signal, to obtain the audio-right channel frequency-domain signal.

It should be understood that, in this embodiment of this disclosure, the audio-left channel frequency-domain signal and the audio-right channel frequency-domain signal may also be referred to as audio-left and audio-right channel frequency-domain signals.

Optionally, the DFT may be performed once per frame. The transformed audio-left channel frequency-domain signal is denoted as L(k), where k=0, 1, . . . , L/2−1. The transformed audio-right channel frequency-domain signal is denoted as R(k), where k=0, 1, . . . , L/2−1, and k is a frequency bin index value.

Optionally, the time-domain preprocessed audio-left and audio-right channel time-domain signals of each frame each may be divided into P subframes, and the DFT is performed once per subframe.

For example, if an audio-left channel time-domain signal of each frame or an audio-right channel time-domain signal of each frame is 20 ms, and a frame length is denoted as N, N=320, that is, the frame length is 320 sampling points. The audio-left channel time-domain signal of each frame or the audio-right channel time-domain signal of each frame is divided into two subframes, that is, P=2. Each subframe of audio-left channel time-domain signal or each subframe of audio-right channel time-domain signal is 10 ms. A subframe length is 160 sampling points. The DFT is performed once per subframe. A length of the DFT is denoted as L. Herein, L=400, that is, a length of the DFT is 400 sampling points. In this case, an audio-left channel frequency-domain signal of an $i^{th}$ subframe after the DFT may be denoted as Li(k), where k=0, 1, . . . , L/2−1, and an audio-right channel frequency-domain signal of the $i^{th}$ subframe after the DFT may be denoted as Ri(k), where k=0, 1, . . . , L/2−1, k is the frequency bin index value, i is the subframe index value, and i=0, 1, . . . , P−1.

Optionally, overlapping addition may be performed on two consecutive times of DFT.

Optionally, zeros may be filled in an input signal of the DFT.

In this way, a problem of spectrum aliasing can be resolved.

104. Determine an ITD parameter and encode the determined ITD parameter.

In this embodiment of this disclosure, there may be a plurality of methods for determining the ITD parameter. The ITD parameter may be determined based on only the audio-left and audio-right channel frequency-domain signals obtained in the step 103 in frequency domain, or determined based on only the audio-left and audio-right channel time-domain signals obtained in the step 101 in time domain, or determined using a method in which time domain processing is combined with frequency domain processing. This is not limited in this embodiment of this disclosure.

In an example, the ITD parameter may be determined using a cross correlation coefficient in time domain.

For example, in a range of $0 \le i \le T_{max}$, after the time-domain preprocessed audio-left and audio-right channel time-domain signals are obtained in the step 101, $$c_n(i) = \sum_{j=0}^{N-1-i} x_{R_HP}(j) \cdot x_{L_HP}(j+i) \text{ and } c_p(i) = \sum_{j=0}^{N-i-i} x_{L_HP}(j) \cdot x_{R_HP}(j+i)$$

are calculated. If $$\max_{0 \le i \le T_{max}} (c_n(i)) > \max_{0 \le i \le T_{max}} (c_p(i)),$$

it can be determined that a value of the ITD parameter is an opposite number of an index value corresponding to max ($c_n$(i)). Otherwise, a value of the ITD parameter is an index value corresponding to max($c_p$(i)).

Herein, i is an index value for calculating a cross correlation coefficient, j is an index value of a sampling point, $T_{max}$ corresponds to a maximum value of a value of an ITD at different sampling frequencies, and N is a frame length.

In an example, the ITD parameter may be determined based on the audio-left and audio-right channel frequency-domain signals in frequency domain.

Optionally, after the audio-left and audio-right channel frequency-domain signals are obtained in the step 103, a frequency-domain cross correlation coefficient of the audio-left and audio-right channel frequency-domain signals is calculated, the frequency-domain cross correlation coefficient is transformed to time domain, and a maximum value of a time-domain cross correlation coefficient is searched in a preset range. In this way, the value of the ITD parameter can be obtained.

For example, after the DFT is used, the audio-left channel frequency-domain signal $L_i$(k) of the $i^{th}$ subframe and the audio-right channel frequency-domain signal $R_i$(k) of the $i^{th}$ subframe are obtained, and a frequency-domain cross correlation coefficient of the $i^{th}$ subframe is calculated according to $XCORR_i(k)=L_i(k)*R^*_i(k)$. Herein, $R^*_i(k)$ is a conjugate signal of $R_i$(k). The frequency-domain cross correlation coefficient is transformed to time domain to obtain the time-domain cross correlation coefficient $xcorr_i$(n), where n=0, 1, . . . , L−1. A maximum value of $xcorr_i$(n) is searched in a range of $$\frac{L}{2} - T_{max} \le n \le \frac{L}{2} + T_{max}$$

to obtain a value $$T_i = \arg \max_{\frac{L}{2}-T_{max} \le n \le \frac{L}{2}+T_{max}} (xcorr_i(n)) - \frac{L}{2}$$

of an ITD parameter of the $i^{th}$ subframe.

Optionally, in a preset range, an amplitude value may be calculated based on the audio-left and audio-right channel frequency-domain signals, and the value of the ITD parameter may be obtained based on the amplitude value.

Optionally, the value of the ITD parameter may be an index value corresponding to a maximum amplitude value.

For example, after the DFT is used, the audio-left channel frequency-domain signal $L_i$(k) of the $i^{th}$ subframe and the audio-right channel frequency-domain signal $R_i$(k) of the $i^{th}$ subframe are obtained, and an amplitude value is calculated in a preset range of $-T_{max} \le j \le T_{max}$ according to $$mag(j) = \sum_{i=0}^{1} \sum_{k=0}^{L/2-1} L_i(k) * R_i(k) * \exp\left(\frac{2\pi * k * j}{L}\right).$$

In this case, the value of the ITD parameter is $$T = \arg \max_{-T_{max} \le j \le T_{max}} (mag(j)).$$

After the ITD parameter is determined, the ITD parameter may be encoded and written into a stereo encoded bitstream.

105. Perform time shift adjustment on the audio-left and audio-right channel frequency-domain signals based on the ITD parameter.

Optionally, the time shift adjustment may be performed once per frame, or the audio-left and audio-right channel frequency-domain signals of each frame may be divided into P subframes, and the time shift adjustment is performed once per subframe.

Optionally, when the audio-left and audio-right channel frequency-domain signals of each frame are divided into P subframes, and the time shift adjustment is performed once per subframe, the time-shift adjusted audio-left channel frequency-domain signal $L_i'$(k) and the audio-right channel frequency-domain signal $R_i'$(k) of the $i^{th}$ subframe may be obtained according to Formula (3):

$$\begin{cases} L_i'(k) = L_i(k) * e^{-j\pi \frac{T_i}{L}} \\ R_i'(k) = R_i(k) * e^{-j\pi \frac{T_i}{L}} \end{cases}. \quad (3)$$

Herein, $T_i$ is the value of the ITD parameter of the $i^{th}$ subframe, and L is the length of the DFT.

It should be understood that, in this embodiment of this disclosure, the time shift adjustment may be performed on the audio-left and audio-right channel frequency-domain signals using any existing technology. This is not limited in this embodiment of this disclosure.

106. Calculate a frequency-domain stereo parameter based on the time-shift adjusted audio-left and audio-right channel frequency-domain signals, and perform encoding.

Optionally, the frequency-domain stereo parameter may include but is not limited to at least one of the following: an inter-channel phase difference (IPD) parameter, an inter-channel level difference (ILD) parameter, a sub-band side gain, and the like.

It should be understood that a name of the ILD parameter is not limited in this embodiment of this disclosure. That is, the ILD parameter may also be referred to as another name. For example, the ILD parameter may also be referred to as an inter-channel amplitude difference parameter.

After the frequency-domain stereo parameter is obtained, the frequency-domain stereo parameter may be encoded and written into an encoded bitstream.

107. Determine whether each sub-band index meets a preset condition.

The audio-left and audio-right channel frequency-domain signals of each frame or the audio-left and audio-right channel frequency-domain signals of each subframe are divided into sub-bands. A frequency bin included in a $b^{th}$ sub-band meets k∈[band_limits(b), band_limits(b+1)−1], where band_limits(b) represents a minimum index value of the frequency bin included in the $b^{th}$ sub-band. In this embodiment of this disclosure, a frequency-domain signal of each subframe may include M sub-bands, and frequency bins included in each sub-band may be determined based on band_limits(b).

Optionally, the preset condition may be that a sub-band index value is less than a preset maximum sub-band index value, that is, b<res_flag_band_max, where res_flag_band_max represents the preset maximum sub-band index value.

Optionally, the preset condition may be that a sub-band index value is less than or equal to a preset maximum sub-band index value, that is, b≤res_flag_band_max.

Optionally, the preset condition may be that a sub-band index value is less than a preset maximum sub-band index value and greater than a preset minimum sub-band index value, that is, res_flag_band_min<b<res_flag_band_max, where res_flag_band_max is the preset minimum sub-band index value.

Optionally, the preset condition may be that a sub-band index value is less than or equal to a preset maximum sub-band index value, and greater than or equal to a preset minimum sub-band index value, that is, res_flag_band_min≤b<res_flag_band_max.

Optionally, the preset condition may be that a sub-band index value is less than or equal to a preset maximum sub-band index value, and greater than a preset minimum sub-band index value, that is, res_flag_band_min≤b<res_flag_band_max.

Optionally, the preset condition may be that a sub-band index value is less than a preset maximum sub-band index value, and greater than or equal to a preset minimum sub-band index value, that is, res_flag_band_min≤b<res_flag_band_max.

It should be noted that preset conditions may be different for different encoding rates and/or different encoding bandwidths.

For example, when an encoding rate is 26 kbps, a preset maximum sub-band index value may be 5, that is, a preset condition may be b<5, when an encoding rate is 44 kbps, a preset maximum sub-band index value may be 6, that is, a preset condition is b<6, or when an encoding rate is 56 kbps, a preset maximum sub-band index value may be 7, that is, a preset condition is b<7.

It should further be noted that if each frame of signal is divided into P subframes, it needs to be determined for a signal of each subframe whether each sub-band index meets a preset condition.

If the sub-band index meets the preset condition, steps 108 and 109 are performed. If the sub-band index does not meet the preset condition, step 110 is performed.

108. If the sub-band index meets the preset condition, a downmixed signal and a residual signal may be calculated based on the time-shift adjusted audio-left and audio-right channel frequency-domain signals obtained in the step 105.

Optionally, the downmixed signal and the residual signal may be calculated according to Formula (4) and Formula (5):

$$DMX_i(k) = \frac{L_i''(k) + R_i''(k)}{2}, \text{ and} \tag{4}$$

$$RES_i'(k) = RES_i(k) - \text{g_ILD}_i * DMX_i(k). \tag{5}$$

Herein:

$$\begin{cases} RES_i(k) = \dfrac{L_i''(k) - R_i''(k)}{2} \\ L_i''(k) = L_i'(k) * e^{-j\beta} \\ R_i''(k) = R_i'(k) * e^{-j(IPD(b)-\beta)} \\ \beta = \arctan(\sin(IPD_i(b), \cos(IDP_i(b)) + 2 * c) \\ c = \dfrac{1 + \text{g_ILD}_i}{1 - \text{g_ILD}_i} \end{cases} . \tag{6}$$

Herein, $DMX_i(k)$ represents a downmixed signal of a $b^{th}$ sub-band of an $i^{th}$ subframe, $RES_i'(k)$ represents a residual signal of the $b^{th}$ sub-band of the $i^{th}$ subframe, $IPD_i(b)$ is an IPD parameter of the $b^{th}$ sub-band of the $i^{th}$ subframe, $g_ILD_i$ a sub-band side gain of the $i^{th}$ subframe, $L_i'(k)$ is a time-shift adjusted audio-left channel frequency-domain signal of the $b^{th}$ sub-band of the $i^{th}$ subframe, $R_i'(k)$ is a time-shift adjusted audio-right channel frequency-domain signal of the $b^{th}$ sub-band of the $i^{th}$ subframe, $L_i''(k)$ is an audio-left channel frequency-domain signal of the $b^{th}$ sub-band of the $i^{th}$ subframe after adjustment based on a plurality of stereo parameters, $R_i''(k)$ is an audio-right channel frequency-domain signal of the $b^{th}$ sub-band of the $i^{th}$ subframe after adjustment based on a plurality of stereo parameters, k is a frequency bin index value, k∈[band_limits(b), band_limits(b+1)−1], band_limits(b) is a minimum index value of a frequency bin included in the $b^{th}$ sub-band, i is a subframe index value, and i=0, 1, . . . , P−1.

Optionally, $DMX_i(k)$ may alternatively be calculated according to the following formulas:

$$DMX_i(k) = [L''(k) + R''(k)] * c, \text{ and} \tag{7}$$

$$c = \sqrt{\frac{1}{2} * \frac{L''(k)^2 + R''(k)^2}{[L''(k) + R''(k)]^2}} . \tag{8}$$

It should be understood that the foregoing method for calculating the downmixed signal and the residual signal is merely an example, and shall not construct any limitation on the range of this embodiment of this disclosure.

109. Determine an encoding mode of the residual signal of the current frame.

Optionally, the encoding mode may be used to indicate whether to encode the residual signal of the current frame.

110. If the sub-band index does not meet the preset condition, a downmixed signal may be calculated based on the time-shift adjusted audio-left and audio-right channel frequency-domain signals obtained in the step 105.

For a method for calculating the downmixed signal, refer to the method for calculating the downmixed signal in the step 108. For brevity of content, details are not described herein again.

It should be noted that, when the sub-band index does not meet the preset condition, the method for calculating the downmixed signal may be the same as the method used when the sub-band index meets the preset condition, or another method for calculating a downmixed signal may be used for calculation.

111. Determine whether a previous frame is a switching frame.

When encoding modes of residual signals of two adjacent frames are different, the latter frame of the two adjacent frames may be a switching frame.

Optionally, a switching flag value may be used to indicate whether the previous frame is a switching frame. When a switching flag value of the previous frame is 1, it indicates that the previous frame is a switching frame. When the switching flag value of the current frame is 0, it indicates that the previous frame is not a switching frame.

For example, the previous frame is a fourth frame, and a residual signal of the previous frame is not encoded. If a residual signal of a third frame is encoded, the previous frame is a switching frame, and a switching flag value of the previous frame is 1. If a residual signal of a third frame is not encoded, the previous frame is not a switching frame, and a switching flag value of the previous frame is 0.

If the previous frame is a switching frame, steps 112 and 113 are performed. If the previous frame is not a switching frame, steps 114 and 115 are performed.

112. Modify the downmixed signal and the residual signal obtained in the step 108.

The modified downmixed signal and the modified residual signal may be used as a downmixed signal and a residual signal of a sub-band corresponding to a preset low frequency band.

113. If it is determined to encode the residual signal of the current frame, transform the modified downmixed signal and the modified residual signal of the current frame to time domain, and perform encoding.

Optionally, inverse time-frequency transform may be used to transform the downmixed signal of the current frame and the residual signal of the current frame to time domain. For example, the inverse transform may be inverse DFT or inverse FFT.

Optionally, if each frame of downmixed signal is divided into sub-frames, and each subframe is divided into sub-bands, downmixed signals of sub-bands of each subframe of the current frame may be integrated to form a downmixed signal of the $i^{th}$ subframe. Then, the downmixed signal of the $i^{th}$ subframe is transformed to time domain through inverse time-frequency transform, and overlapping addition processing is performed on subframes to obtain a time-domain downmixed signal of the current frame.

In this embodiment of this disclosure, the time-domain downmixed signal and a time-domain residual signal of the current frame may be encoded using any existing technology, to obtain an encoded bitstream of the downmixed signal and the residual signal, and the encoded bitstream is written into a stereo encoded bitstream.

114. If the previous frame is not a switching frame, modify the downmixed signal obtained in the step 108 and the downmixed signal obtained in the step 110.

The modified downmixed signal may be used as a downmixed signal of a sub-band corresponding to a preset low frequency band.

Optionally, a downmixed compensation factor of the current frame may be calculated based on the audio-left channel frequency-domain signal and the audio-right channel frequency-domain signal of the current frame that are obtained in the step 103, then the compensated downmixed signal may be calculated based on the audio-left channel frequency-domain signal, the audio-right channel frequency-domain signal, and the downmixed compensation factor of the current frame, and the modified downmixed signal may be calculated based on the downmixed signal and the compensated downmixed signal.

115. Transform the modified downmixed signal to time domain, and perform encoding.

For an implementation of the step 115, refer to a specific implementation of the step 113. For brevity, details are not described herein again.

The bitstream finally obtained in the foregoing method may be transmitted to a decoding end. The decoding end may decode the received bitstream to obtain the downmixed signal and the residual signal of the current frame, and perform specified processing to obtain the decoded stereo signal.

In the process of determining whether to encode the residual signal (for example, the step 109), if a residual signal of any frame is not encoded, a spatial sense of the decoded stereo signal is relatively poor, and audio-video stability is greatly how accurately a stereo parameter is extracted. However, if residual signals of corresponding sub-bands in a preset bandwidth range are uniformly encoded, some signals with more abundant high-frequency information are generated. Because a sufficient quantity of bits cannot be allocated to encode a downmixed signal, high-frequency distortion of a decoded stereo signal becomes large, which reduces overall quality of the encoding.

This disclosure provides a stereo signal encoding method. In this method, whether to encode a residual signal of a current frame may be determined based on a factor related to an encoding mode of the residual signal of the current frame. Therefore, the determined encoding mode of the residual signal of the current frame has relatively high accuracy in this disclosure, which can better improve encoding quality of the stereo signal.

Figure 2:
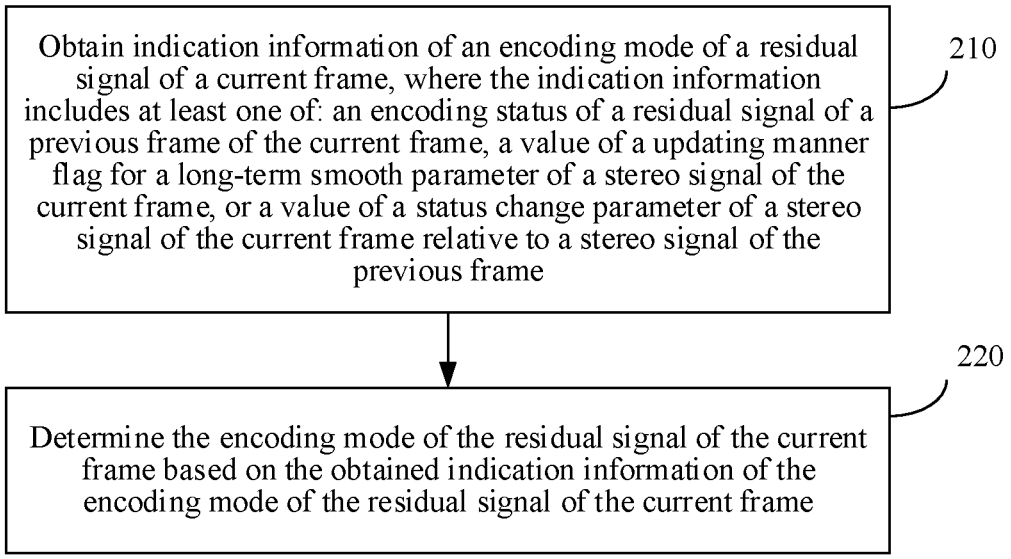
FIG. 2 is a schematic flowchart of a stereo signal encoding method according to an embodiment of this disclosure.

The following describes in detail a specific implementation of the step 109 shown in FIG. 2 using examples. The method in FIG. 2 may be performed by an encoding end. The encoding end may be an encoder or a device that has a function of encoding a stereo signal.

FIG. 2 is a schematic flowchart of a stereo signal encoding method according to an embodiment of this disclosure. FIG. 2 is described using an example of a frame currently being processed by the encoding end. However, it should be understood that the technical solution in this embodiment of this disclosure may also be applied to any frame being processed by the encoding end.

The method in FIG. 2 may include steps 210 and 220. The following separately describes the steps 210 and 220 in detail.

210. The encoding end obtains indication information of an encoding mode of a residual signal of a current frame.

The indication information may include at least one of an encoding status of a residual signal of a previous frame of the current frame, a value of an updating manner flag for a long-term smooth parameter of a stereo signal of the current frame, or a value of a status change parameter of a stereo signal of the current frame relative to a stereo signal of the previous frame.

In this embodiment of this disclosure, the residual signal may indicate a difference between an audio-left channel signal and an audio-right channel signal. That is, a larger value of the residual signal indicates a larger difference between the audio-left channel signal and the audio-right channel signal.

Optionally, the encoding end may determine at least one of the encoding status of the residual signal of the previous frame, the value of the updating manner flag for the long-term smooth parameter, or the value of the status change parameter.

It may be preset on a system that when the encoding end processes any frame, the encoding end may determine at least one of an encoding status of a residual signal of a previous frame of any frame, a value of an updating manner flag for a long-term smooth parameter of any frame, or a value of a status change parameter relative to the stereo signal of the previous frame.

It should be noted that this embodiment of this disclosure does not limit how the encoding end determines at least one of the encoding status of the residual signal of the previous frame of any frame, the value of the updating manner flag for the long-term smooth parameter, or the value of the status change parameter. Any method that can be used to determine at least one of the encoding status of the residual signal of the previous frame of any frame, the value of the updating manner flag for the long-term smooth parameter, or the value of the status change parameter falls within the protection scope of this disclosure.

Optionally, the encoding end may obtain at least one of the encoding status of the residual signal of the previous frame, the value of the updating manner flag for the long-term smooth parameter, or the value of the status change parameter based on configuration information of the system.

In an example, the system may store an encoding status of a residual signal of each frame, a value of an updating manner flag for a long-term smooth parameter, and a value of a status change parameter. When the encoding end processes the current frame, after the encoding status of the residual signal of the previous frame, the value of the updating manner flag for the long-term smooth parameter, and the value of the status change parameter are determined, the system sends the configuration information to the encoding end. The configuration information may be used to indicate at least one of the encoding status of the residual signal of the previous frame, the value of the updating manner flag for the long-term smooth parameter, and the value of the status change parameter such that the encoding end can obtain at least one of the encoding status of the residual signal of the previous frame, the value of the updating manner flag for the long-term smooth parameter, and the value of the status change parameter.

Optionally, the encoding status of the residual signal of the previous frame may be used to indicate at least one of the following cases: a quantity of consecutive frames whose residual signals are encoded before the current frame, a quantity of consecutive frames whose residual signals are not encoded before the current frame, or encoding modes of residual signals of N preceding frames of the current frame, where N is a positive integer.

The N preceding frames of the current frame are consecutive in time domain, and the N preceding frames of the current frame include a previous frame closely adjacent to the current frame.

Optionally, a value of a tailing controller may be used to indicate a quantity of consecutive frames that are kept in a same encoding mode of residual signals. It should be noted that in this embodiment of this disclosure, the tailing controller has a counting function.

For example, a value of a tailing controller 0 may indicate a quantity of consecutive frames whose residual signals are encoded, and a value of a tailing controller 1 may indicate a quantity of consecutive frames whose residual signals are not encoded.

For example, if the current frame is a fourth frame, the encoding mode of the residual signal indicates to encode the residual signal, encoding modes of residual signals of a second frame and a third frame also indicate to encode the residual signals, and an encoding mode of a residual signal of a first frame indicates not to encode the residual signal. In this case, the value of the tailing controller 0 is 3.

For another example, if the current frame is a fourth frame, the encoding mode of the residual signal indicates to encode the residual signal, and an encoding mode of a residual signal of a third frame indicates not to encode the residual signal. In this case, the value of the tailing controller 1 is 1.

Optionally, the value of the status change parameter may include a ratio of energy of the stereo signal of the current frame to energy of the stereo signal of M preceding frames of the current frame, where the M preceding frames of the current frame are consecutive in time domain, the M preceding frames of the current frame include the previous frame closely adjacent to the current frame, and M is a positive integer, or a ratio of an amplitude of the stereo signal of the current frame to an amplitude of the stereo signal of S preceding frames of the current frame, where the S preceding frames of the current frame are consecutive in time domain, the S preceding frames of the current frame include the previous frame closely adjacent to the current frame, and S is a positive integer.

Optionally, the value of the status change parameter may further be used to indicate a ratio of a frequency of the stereo signal of the current frame to a frequency of a stereo signal of a previous frame, a power ratio of a frequency of the stereo signal of the current frame to a frequency of a stereo signal of a previous frame, or the like.

It should be noted herein that, in different conditions, the stereo signal in this embodiment of this disclosure may have different statuses. For example, in a condition 1, a state of a stereo signal may be energy, in a condition 2, a state of a stereo signal may be an amplitude, or in a condition 3, a state of a stereo signal may be power.

Optionally, the encoding end may obtain the value of the updating manner flag for the long-term smooth parameter based on an energy fluctuation ratio and/or an energy ratio between the current frame and the previous frame. The value of the updating manner flag for the long-term smooth parameter of the current frame may be used to indicate which one of at least two manners for updating a long-term smooth parameter is the updating manner for the long-term smooth parameter of the current frame. For example, when there are two preset manners for updating a long-term smooth parameter, if the value of the updating manner flag for the long-term smooth parameter is 1, it indicates that the updating manner for the long-term smooth parameter of the current frame is one of the two preset update manners. Otherwise, if the value of the updating manner flag for the long-term smooth parameter of the current frame is 0, it indicates that the updating manner for the long-term smooth parameter of the current frame is the other one of the two preset update manners.

Optionally, the energy fluctuation ratio between the current frame and the previous frame, that is, an inter-frame energy fluctuation ratio, may be a ratio of total energy of the downmixed signal of the current frame and the residual signal of the current frame to total energy of the downmixed signal of the previous frame and the residual signal of the previous frame. That is:

$$\text{frame_nrg_ratio}=\text{dmx_res_all}/\text{dmx_res_all_prev, and} \tag{9}$$

$$\text{dmx_res_all}=\text{res_nrg_all_curr}+\text{dmx_nrg_all_curr.} \tag{10}$$

Herein, frame_nrg_ratio represents the inter-frame energy fluctuation ratio, dmx_res_all represents the total energy of the stereo signal of the current frame, dmx_res_all_prev represents the total energy of the stereo signal of the previous frame, res_nrg_all_curr represents total energy of the residual signal of the current frame, and dmx_nrg_all_curr represents total energy of the downmixed signal of the current frame.

Optionally, the energy ratio may be obtained according to the following formulas:

$$\text{res_dmx_ratio}=\max(\text{res_dmx_ratio}[0],\text{res_dmx_ratio}[1],\ldots,\text{res_dmx_ratio}[\text{res_flag_band_max}]), \tag{11}$$

$$\text{res_dmx_ratio}[b]=\text{res_cod_NRG_}S[b]/(\text{res_cod_NRG_}S[b]+(1-g(b))(1-g(b))*\text{res_cod_NRG_}M[b]+1)\text{, and} \tag{12}$$

$$g(b)=0.5*\text{side_gain1}[b]+0.5*\text{side_gain2}[b]. \tag{13}$$

Herein, res_dmx_ratio represents the energy ratio, side_gain1[b] and side_gain2[b] respectively represents a side gain of a sub-band b of a subframe 1 and a side gain of a sub-band b of a subframe 2, res_cod_NRG_M[b] represents energy of a downmixed signal in a sub-band whose sub-band index is b, res_cod_NRG_S[b] represents energy of a residual signal in a sub-band whose sub-band index is b, and res_flag_band_max represents a preset maximum sub-band index value.

In an example, if the inter-frame energy fluctuation ratio is greater than a first preset value, and the energy ratio is less than a second preset value, the value of the updating manner flag for the long-term smooth parameter is 1. Otherwise, the value of the updating manner flag for the long-term smooth parameter is 0.

For example, it is assumed that the first preset value is 3.2, and the second preset value is 0.1. When frame_nrg_ratio>3.2 and res_dmx_ratio<0.1, the value of the updating manner flag for the long-term smooth parameter is 1. When frame_nrg_ratio≤3.2, for example, frame_nrg_ratio=4.1, the value of the updating manner flag for the long-term smooth parameter is 0.

In an example, if the inter-frame energy fluctuation ratio is less than a third preset value, and the energy ratio is greater than a fourth preset value, the value of the updating manner flag for the long-term smooth parameter is 1. Otherwise, the value of the updating manner flag for the long-term smooth parameter is 0.

For example, it is assumed that the third preset value is 0.21, and the fourth preset value is 0.4. When frame_nrg_ratio<0.21 and res_dmx_ratio>0.4, the value of the updating manner flag for the long-term smooth parameter is 1.

Different flag values of manners for updating a long-term smooth parameter indicate different methods for calculating a long-term smooth parameter.

When the value of the updating manner flag for the long-term smooth parameter is 1, the encoding end may calculate the long-term smooth parameter of the stereo signal of the current frame according to Formula (14):

$$\text{res_dmx_ratio_lt}=\text{res_dmx_ratio}*\alpha1+\text{res_dmx_ratio_lt_prev}*(1-\alpha1). \tag{14}$$

When the value of the updating manner flag for the long-term smooth parameter is 0, the encoding end may calculate the long-term smooth parameter of the stereo signal of the current frame according to Formula (15):

$$\text{res_dmx_ratio_lt}=\text{res_dmx_ratio}*\alpha2+\text{res_dmx_ratio_lt_prev}*(1-\alpha2). \tag{15}$$

Herein, res_dmx_ratio_lt represents the long-term smooth parameter of the stereo signal of the current frame, res_dmx_ratio_lt_prev represents a long-term smooth parameter of the stereo signal of the previous frame, $\alpha1$ and $\alpha2$ are parameters, $0<\alpha1<1$, $0<\alpha2<1$, and $\alpha1>\alpha2$. For example, $\alpha1$ may be 0.5, and $\alpha2$ may be 0.1.

It should be understood that the value of the updating manner flag for the long-term smooth parameter is a manner for indicating the long-term smooth parameter. In this embodiment of this disclosure, another indication manner may also be used to indicate the updating manner for the long-term smooth parameter of the stereo signal of the current frame. This is not limited in this embodiment of this disclosure.

It should be noted that if the current frame is a first frame, the previous frame of the current frame does not exist. In this case, when the encoding end determines the long-term smooth parameter of the current frame, the long-term smooth parameter of the stereo signal of the previous frame in Formula (14) and Formula (15) may be the preset long-term smooth parameter. The preset long-term smooth parameter may be preset by the encoding end, or may be preset on the system.

220. The encoding end determines the encoding mode of the residual signal of the current frame based on the obtained indication information of the encoding mode of the residual signal of the current frame.

Optionally, in an implementation, before the encoding end determines the encoding mode of the residual signal of the current frame based on the obtained indication information of the encoding mode of the residual signal of the current frame, the encoding end may first determine an initial encoding mode of the residual signal of the current frame, and then determine the encoding mode of the residual signal of the current frame based on the indication information of the encoding mode of the residual signal of the current frame and the initial encoding mode of the residual signal of the current frame.

In the foregoing technical solution, the encoding end first determines the initial encoding mode of the residual signal of the current frame, and then determines the encoding mode based on the initial encoding mode. Because the initial encoding mode of the residual signal of the current frame is related to the encoding mode of the residual signal of the current frame, the encoding mode determined based on the initial encoding mode has relatively high accuracy, thereby better improving encoding quality of a stereo signal.

Optionally, the encoding end may determine the initial encoding mode of the residual signal of the current frame based on energy of the downmixed signal of the current frame and energy of the residual signal of the current frame.

It should be understood that a name of the downmixed signal and a name of the residual signal are not limited in this embodiment of this disclosure. That is, the downmixed signal and the residual signal may also be referred to as other names. For example, the downmixed signal may also be referred to as a central audio channel signal or a main audio channel signal, and the residual signal may also be referred to as a side audio channel signal or a secondary audio channel signal.

Optionally, the encoding end may determine the initial encoding mode of the residual signal of the current frame based on a parameter indicating an energy relationship between the downmixed signal of the current frame and the residual signal of the current frame, and/or another parameter.

For example, the encoding end may determine the initial encoding mode based on at least one of the following parameters: a voice/music classification result, a voice activation detection result, residual signal energy, a parameter of a correlation between audio-left and audio-right frequency-domain signals, and the like.

In an example, when the energy relationship between the downmixed signal of the current frame and the residual signal of the current frame or the parameter indicating the energy relationship between the downmixed signal of the current frame and the residual signal of the current frame meets a preset condition, the encoding end may determine that the initial encoding mode indicates to encode the residual signal of the current frame, or otherwise, determine that the initial encoding mode indicates not to encode the residual signal of the current frame.

Optionally, the preset condition may be that the energy relationship between the downmixed signal of the current frame and the residual signal of the current frame or the parameter indicating the energy relationship between the downmixed signal of the current frame and the residual signal of the current frame is greater than a preset threshold.

A value range of the preset threshold may be (0, 1.0).

For example, the preset threshold is 0.075. If the parameter indicating the energy relationship between the downmixed signal of the current frame and the residual signal of the current frame is 0.06, because 0.06<0.075, the encoding end may determine that the initial encoding mode indicates not to encode the residual signal of the current frame, or if the parameter indicating the energy relationship between the downmixed signal of the current frame and the residual signal of the current frame is 0.08, because 0.08>0.075, the encoding end may determine that the initial encoding mode indicates to encode the residual signal of the current frame.

It should be understood that the foregoing value of the preset threshold is merely an example, and shall not construct any limitation on the range of this embodiment of this disclosure. For example, the preset threshold may be another value in a range of (0, 1.0).

The initial encoding mode is determined based on the energy of the downmixed signal in a preset bandwidth range and the energy of the residual signal in the preset bandwidth range. In this way, the following problem can be avoided. Only a downmixed signal is encoded when an encoding rate is low, or residual signals of corresponding sub-bands in a preset bandwidth range are uniformly encoded. Therefore, this can ensure a spatial sense and audio-video stability of the decoded stereo signal, and reduce high-frequency distortion of the decoded stereo signal, thereby improving overall encoding quality.

It should be understood that, the term "and/or" in the embodiments of this disclosure describes only an association relationship for describing associated objects and represents that three relationships may exist. For example, A and/or B may represent the following three cases: only A exists, both A and B exist, and only B exists.

It should further be understood that, in this embodiment of this disclosure, an example in which N=1, that is, the encoding status of the residual signal of the previous frame of the current frame may be used to indicate the encoding mode of the residual signal of the previous frame of the current frame is used to describe how the encoding end determines the encoding mode of the residual signal of the current frame based on the obtained indication information of the encoding mode of the residual signal of the current frame. However, this disclosure is not limited thereto. In this disclosure, the encoding mode of the residual signal of the current frame may alternatively be determined based on the encoding modes of the residual signals of the N preceding frames of the current frame.

In an implementation, when the indication information of the encoding mode of the residual signal of the current frame includes the encoding status of the residual signal of the previous frame of the current frame, and the encoding status of the residual signal of the previous frame of the current frame indicates encoding the residual signals of the N preceding frames of the current frame, the encoding end may determine the encoding mode of the residual signal of the current frame based on the encoding status of the previous frame and the initial encoding mode.

Optionally, if the initial encoding mode is the same as an encoding mode of a residual signal of the previous frame closely adjacent to the current frame, the encoding end may determine that the encoding mode of the residual signal of the current frame is the initial encoding mode. That is, the initial encoding mode is kept.

For example, if the initial encoding mode of the residual signal of the current frame indicates to encode the residual signal, and the encoding mode of the residual signal of the previous frame also indicates to encode the residual signal, the encoding end may determine that the encoding mode of the residual signal of the current frame indicates to encode the residual signal.

For another example, if the initial encoding mode of the residual signal of the current frame indicates not to encode the residual signal, and the encoding mode of the residual signal of the previous frame also indicates not to encode the residual signal, the encoding end may determine that the encoding mode of the residual signal of the current frame indicates not to encode the residual signal of the current frame.

Optionally, if the initial encoding mode is different from the encoding mode of the residual signal of the previous frame of the current frame, and the encoding mode of the residual signal of the previous frame indicates to encode the residual signal of the previous frame, the encoding end may determine that the encoding mode of the residual signal of the current frame is the initial encoding mode.

In an implementation, the indication information of the encoding mode of the residual signal of the current frame includes the encoding status of the residual signal of the previous frame of the current frame and/or the value of the updating manner flag for the long-term smooth parameter. The encoding status of the residual signal of the previous frame of the current frame indicates the quantity of consecutive frames whose residual signals are encoded before the current frame, and the encoding modes of the residual signals of the N preceding frames of the current frame. The initial encoding mode is different from the encoding mode of the residual signal of the previous frame of the current frame. The encoding mode of the residual signal of the previous frame indicates to encode the residual signal of the previous frame. In this case, the encoding end may determine the encoding mode of the residual signal of the current frame based on the encoding status of the previous frame and/or the value of the updating manner flag for the long-term smooth parameter.

In an example, the encoding end may determine the encoding mode of the residual signal of the current frame based on the encoding status of the previous frame.

Optionally, when a first condition is met, the encoding end may determine that the encoding mode of the residual signal of the current frame is the encoding mode of the residual signal of the previous frame.

Optionally, a first condition may include that the quantity of consecutive frames whose residual signals are encoded before the current frame is less than a first threshold.

In this case, the value of the tailing controller 0 may be increased by 1, which indicates that the quantity of consecutive frames whose residual signals are encoded before the current frame is increased by 1.

Optionally, if the first condition is not met, that is, the quantity of consecutive frames whose residual signals are encoded before the current frame is greater than or equal to the first threshold, the encoding end may determine that the encoding mode of the residual signal of the current frame is the initial encoding mode.

In this case, the value of the tailing controller 0 may be set to 0.

For example, the first threshold is 3, the current frame is a fifth frame, and encoding modes of residual signals of a fourth frame and a third frame both indicate to encode the residual signals, and an encoding mode of a residual signal of a second frame indicates not to encode the residual signal. In this case, the quantity of consecutive frames whose residual signals are encoded before the current frame is 2. Because 2 is less than 3, the first condition is met. The encoding end may determine that the encoding mode of the residual signal of the current frame is the same as the encoding mode of the residual signal of the previous frame, that is, the encoding mode of the residual signal of the current frame indicates to encode the residual signal of the current frame.

If encoding modes of residual signals of a first frame to a fourth frame indicate to encode the residual signals, the quantity of consecutive frames whose residual signals are encoded before the current frame is 4. Because 4 is greater than 3, the first condition is not met. Therefore, the encoding end may determine that the encoding mode of the residual signal of the current frame is the same as the initial encoding mode.

In an example, the encoding end may determine the encoding mode of the residual signal of the current frame based on the encoding status of the previous frame and/or the value of the updating manner flag for the long-term smooth parameter.

Optionally, the first condition may further include that the value of the updating manner flag for the long-term smooth parameter is 0, and that the encoding mode of the residual signal of the previous frame is not modified.

Optionally, when the first condition is met, the encoding end may determine that the encoding mode of the residual signal of the current frame is the encoding mode of the residual signal of the previous frame.

That is, the encoding end may determine the encoding mode of the residual signal of the current frame based on the encoding status of the previous frame and the value of the updating manner flag for the long-term smooth parameter.

For example, the first threshold is 3, the current frame is a fifth frame, and encoding modes of residual signals of a fourth frame and a third frame both indicate to encode the residual signals, and an encoding mode of a residual signal of a second frame indicates not to encode the residual signal. In this case, the quantity of consecutive frames whose residual signals are encoded before the current frame is 2. Herein, 2 is less than 3, the encoding mode of the residual signal of the fourth frame is not modified, and the value of the updating manner flag for the long-term smooth parameter is 0. The encoding end may determine that the encoding mode of the residual signal of the current frame is the same as the encoding mode of the residual signal of the previous frame, that is, the encoding mode of the residual signal of the current frame indicates to encode the residual signal of the current frame.

If the first condition is not met, that is, the quantity of consecutive frames whose residual signals are encoded before the current frame is greater than or equal to the first threshold, the value of the updating manner flag for the long-term smooth parameter is 1, and/or the encoding mode of the residual signal of the previous frame is modified, the encoding end may determine that the encoding mode of the residual signal of the current frame is the initial encoding mode.

In this case, optionally, the encoding end may determine, based on the value of the updating manner flag for the long-term smooth parameter, that the encoding mode of the residual signal of the current frame is the initial encoding mode.

For example, the first threshold is 3, the current frame is a fifth frame, and encoding modes of residual signals of a fourth frame and a third frame both indicate to encode the residual signals, and an encoding mode of a residual signal of a second frame indicates not to encode the residual signal. In this case, the quantity of consecutive frames whose residual signals are encoded before the current frame is 2. Herein, 2 is less than 3, and the value of the updating manner flag for the long-term smooth parameter of the stereo signal of the current frame is 1. The quantity of consecutive frames whose residual signals are encoded before the current frame is less than the first threshold. The value of the updating manner flag for the long-term smooth parameter is 1. Therefore, the encoding end may determine that the encoding mode of the residual signal of the current frame is the initial encoding mode.

Optionally, the encoding end may determine, based on the encoding status of the previous frame, that the encoding mode of the residual signal of the current frame is the initial encoding mode.

For example, if the encoding mode that is of the residual signal of the previous frame and that is determined by the encoding end indicates to encode the residual signal, after specified processing, the encoding mode of the residual signal of the previous frame is modified to indicate not to encode the residual signal. In this case, the encoding end may determine that the encoding mode of the residual signal of the current frame is the initial encoding mode.

Optionally, a modification flag value of the encoding mode of the residual signal may indicate whether the encoding mode of the residual signal is modified, that is, whether the encoding mode modifies the encoding mode of the residual signal. When the modification flag value of the encoding mode of the residual signal is 1, it indicates that the encoding mode of the residual signal is modified. When the modification flag value of the encoding mode of the residual signal is 0, it indicates that the encoding mode of the residual signal is not modified.

For example, the encoding mode that is of the residual signal of the previous frame and that is determined by the encoding end indicates to encode the residual signal of the previous frame. After specified processing, the encoding mode of the residual signal of the previous frame is modified to indicate not to encode the residual signal of the previous frame. In this case, the encoding mode of the residual signal of the previous frame is modified, and the modification flag value of the encoding mode of the residual signal of the previous frame is 1.

In the foregoing technical solution, the first threshold is set, the quantity of consecutive frames whose residual signals are encoded before the current frame is compared with the first threshold, and the encoding mode of the residual signal of the current frame is determined based on a comparison result. Therefore, the following case is avoided. When the quantity of consecutive frames whose residual signals are encoded before the current frame meets any condition, the encoding mode of the residual signal of the current frame is determined to indicate to encode or not to encode the residual signal. In this way, the determined encoding mode of the residual signal of the current frame has relatively high accuracy and is close to an actual encoding mode of the residual signal of the current frame.

In an implementation, the indication information of the encoding mode of the residual signal of the current frame includes the encoding status of the residual signal of the previous frame of the current frame and/or the value of the status change parameter. The encoding status of the residual signal of the previous frame of the current frame indicates the quantity of consecutive frames whose residual signals are not encoded before the current frame, and the encoding modes of the residual signals of the N preceding frames of the current frame. The initial encoding mode is different from the encoding mode of the residual signal of the previous frame of the current frame. The encoding mode of the residual signal of the previous frame indicates not to encode the residual signal of the previous frame. In this case, the encoding end may determine the encoding mode of the residual signal of the current frame based on the encoding status of the previous frame and/or the value of the status change parameter.

In an example, the encoding end may determine the encoding mode of the residual signal of the current frame based on the encoding status of the previous frame.

Optionally, when a second condition is met, the encoding end may determine that the encoding mode of the residual signal of the current frame is the encoding mode of the residual signal of the previous frame.

Optionally, the second condition may include that the quantity of consecutive frames whose residual signals are not encoded before the current frame is less than a first threshold.

In this case, the value of the tailing controller 1 is increased by 1.

Optionally, if the second condition is not met, that is, the quantity of consecutive frames whose residual signals are not encoded before the current frame is greater than or equal to the first threshold, the encoding end may determine that the encoding mode of the residual signal of the current frame is the initial encoding mode.

In this case, the value of the tailing controller 1 is set to 0.

For example, the first threshold is 3, the current frame is a fifth frame, and encoding modes of residual signals of a fourth frame and a third frame both indicate not to encode the residual signals, and an encoding mode of a residual signal of a second frame indicates to encode the residual signal. In this case, the quantity of consecutive frames whose residual signals are not encoded before the current frame is 2. Because 2 is less than 3, the second condition is met. The encoding end may determine that the encoding mode of the residual signal of the current frame is the same as the encoding mode of the residual signal of the previous frame, that is, the encoding mode of the residual signal of the current frame indicates not to encode the residual signal of the current frame.

If encoding modes of residual signals of a first frame to a fourth frame indicate not to encode the residual signals, the quantity of consecutive frames whose residual signals are not encoded before the current frame is 4. Because 4 is greater than 3, the second condition is not met. Therefore, the encoding end may determine that the encoding mode of the residual signal of the current frame is the same as the initial encoding mode.

In an example, the encoding end may determine the encoding mode of the residual signal of the current frame based on the encoding status of the previous frame and/or the value of the status change parameter.

Optionally, the second condition may further include that the value of the status change parameter is greater than or equal to a second threshold, and less than or equal to a third threshold.

Optionally, when the second condition is met, the encoding end may determine that the encoding mode of the residual signal of the current frame is the encoding mode of the residual signal of the previous frame.

That is, the encoding end may determine the encoding mode of the residual signal of the current frame based on the encoding status of the previous frame and the value of the status change parameter.

For example, the encoding end may first determine a magnitude relationship between the value of the status change parameter and each of the second threshold and the third threshold. If the value of the status change parameter is greater than or equal to the second threshold, and less than or equal to the third threshold, the encoding end further determines a magnitude relationship between the first threshold and the quantity of consecutive frames whose residual signals are not encoded before the current frame. If the quantity of consecutive frames whose residual signals are not encoded before the current frame is less than the first threshold, the encoding end may determine that the encoding mode of the residual signal of the current frame is the encoding mode of the residual signal of the previous frame.

If the second condition is not met, that is, the quantity of consecutive frames whose residual signals are not encoded before the current frame is greater than or equal to the first threshold, or the value of the status change parameter is greater than the third threshold or less than the second threshold, the encoding end may determine that the encoding mode of the residual signal of the current frame is the initial encoding mode.

In this case, optionally, the encoding end may determine, based on the encoding status of the previous frame and the value of the status change parameter, that the encoding mode of the residual signal of the current frame is the initial encoding mode.

For example, the encoding end may first determine a magnitude relationship between the value of the status change parameter and each of the second threshold and the third threshold. If the value of the status change parameter is greater than or equal to the second threshold, and less than or equal to the third threshold, the encoding end further determines a magnitude relationship between the first threshold and the quantity of consecutive frames whose residual signals are not encoded before the current frame. If the quantity of consecutive frames whose residual signals are not encoded before the current frame is greater than or equal to the first threshold, the encoding end may determine that the encoding mode of the residual signal of the current frame is the initial encoding mode.

Optionally, the encoding end may determine, based on the value of the status change parameter, that the encoding mode of the residual signal of the current frame is the initial encoding mode.

For example, the encoding end determines the magnitude relationship between the value of the status change parameter and each of the second threshold and the third threshold. If the value of the status change parameter is greater than the third threshold or less than the second threshold, the encoding end may determine that the encoding mode of the residual signal of the current frame is the initial encoding mode.

In the foregoing technical solution, because the residual signal of the current frame and the residual signal of the previous frame are consecutive in terms of time, it is first determined whether the encoding mode of the residual signal of the previous frame is the same as the initial encoding mode of the residual signal of the current frame, and then the encoding mode that is of the residual signal of the current frame and that is further determined based on a result of the determining has relatively high accuracy, thereby better improving encoding quality of a stereo signal.

Optionally, in an implementation, the encoding end may determine the encoding mode of the residual signal of the current frame based on at least one of the encoding status of the residual signal of the previous frame, the value of the updating manner flag for the long-term smooth parameter, or the value of the status change parameter.

It should be noted that this embodiment of this disclosure does not limit how the encoding end determines the encoding mode of the residual signal of the current frame based on at least one of the encoding status of the residual signal of the previous frame, the value of the updating manner flag for the long-term smooth parameter, or the value of the status change parameter. Any method that can be used to determine the encoding mode of the residual signal of the current frame based on at least one of the encoding status of the residual signal of the previous frame, the value of the updating manner flag for the long-term smooth parameter, or the value of the status change parameter falls within the protection scope of this disclosure.

Optionally, the method may further include that the encoding end modifies the encoding mode of the residual signal of the current frame based on the indication information of the encoding mode of the residual signal of the current frame.

In a possible implementation, when the indication information of the encoding mode of the residual signal of the current frame includes the encoding status of the residual signal of the previous frame of the current frame, and the encoding status of the residual signal of the previous frame of the current frame indicates the encoding modes of the residual signals of the N preceding frames of the current frame, the encoding end may modify the encoding mode of the residual signal of the current frame based on the encoding mode of the residual signal of the previous frame of the current frame.

Further, if the encoding mode of the residual signal of the current frame is different from the encoding mode of the residual signal of the previous frame of the current frame, and the encoding mode of the residual signal of the previous frame is not modified, the encoding end may modify the encoding mode of the residual signal of the current frame to indicate to encode the residual signal of the current frame.

In this case, the encoding end may determine that the current frame is a switching frame.

For example, the encoding mode that is of the residual signal of the current frame and that is determined by the encoding end indicates not to encode the residual signal of the current frame. The encoding mode of the residual signal of the previous frame indicates to encode the residual signal of the previous frame. The encoding end does not modify the encoding mode of the residual signal of the previous frame. In this case, the encoding end may modify the encoding mode of the residual signal of the current frame to indicate to encode the residual signal of the current frame.

Optionally, if the encoding mode of the residual signal of the current frame is different from the encoding mode of the residual signal of the previous frame, and the encoding mode of the residual signal of the previous frame is not modified, the encoding end may further determine whether the encoding mode of the residual signal of the current frame indicates not to encode the residual signal of the current frame. If the encoding mode of the residual signal of the current frame indicates not to encode the residual signal of the current frame, the encoding end may modify the encoding mode of the residual signal of the current frame to indicate to encode the residual signal of the current frame. If the encoding mode of the residual signal of the current frame indicates to encode the residual signal of the current frame, the encoding end keeps the encoding mode of the current frame unmodified, that is, does not modify the encoding mode of the residual signal of the current frame.

Optionally, if the encoding mode of the residual signal of the current frame is the same as the encoding mode of the residual signal of the previous frame, and/or the encoding mode of the residual signal of the previous frame is modified, the encoding end does not modify the encoding mode of the residual signal of the current frame and keeps the determined encoding mode of the residual signal of the current frame.

For example, if the encoding mode that is of the residual signal of the current frame and that is determined by the encoding end indicates not to encode the residual signal of the current frame, and the encoding mode of the residual signal of the previous frame indicates to encode the residual signal of the previous frame, the encoding end does not modify the encoding mode of the residual signal of the current frame.

For another example, if the encoding mode that is of the residual signal of the previous frame and that is determined by the encoding end indicates not to encode the residual signal of the previous frame, and the encoding mode of the residual signal of the previous frame is modified to indicate to encode the residual signal of the previous frame, the encoding end does not modify the encoding mode of the residual signal of the current frame and keeps the determined encoding mode of the residual signal of the current frame.

In the foregoing technical solution, after the encoding mode of the residual signal of the current frame is determined, if a specified condition is met, the encoding mode of the residual signal of the current frame may be modified such that the finally determined encoding mode of the current frame is more accurate, thereby further improving encoding quality of a stereo signal.

FIG. 3 to FIG. 6 are four different flowcharts to which the embodiments of this disclosure can be applied. The following describes the embodiments of this disclosure with reference to accompanying drawings.

In FIG. 3 to FIG. 6, P1 represents an initial encoding mode of a residual signal of a current frame, P2 represents an encoding mode of a residual signal of a previous frame, P3 represents a value of a tailing controller in a mode 0, P4 represents a value of a tailing controller in a mode 1, P5 represents a value of a updating manner flag for a long-term smooth parameter, P6 represents a modification flag value of the encoding mode of the residual signal of the previous frame, P7 represents a value of a status change parameter, P8 represents an encoding mode of the residual signal of the current frame, and P9 represents a switching flag value of the current frame. It is assumed that a first threshold is 3, a second threshold is 0.21, and a third threshold is 2.5.

Figure 3:
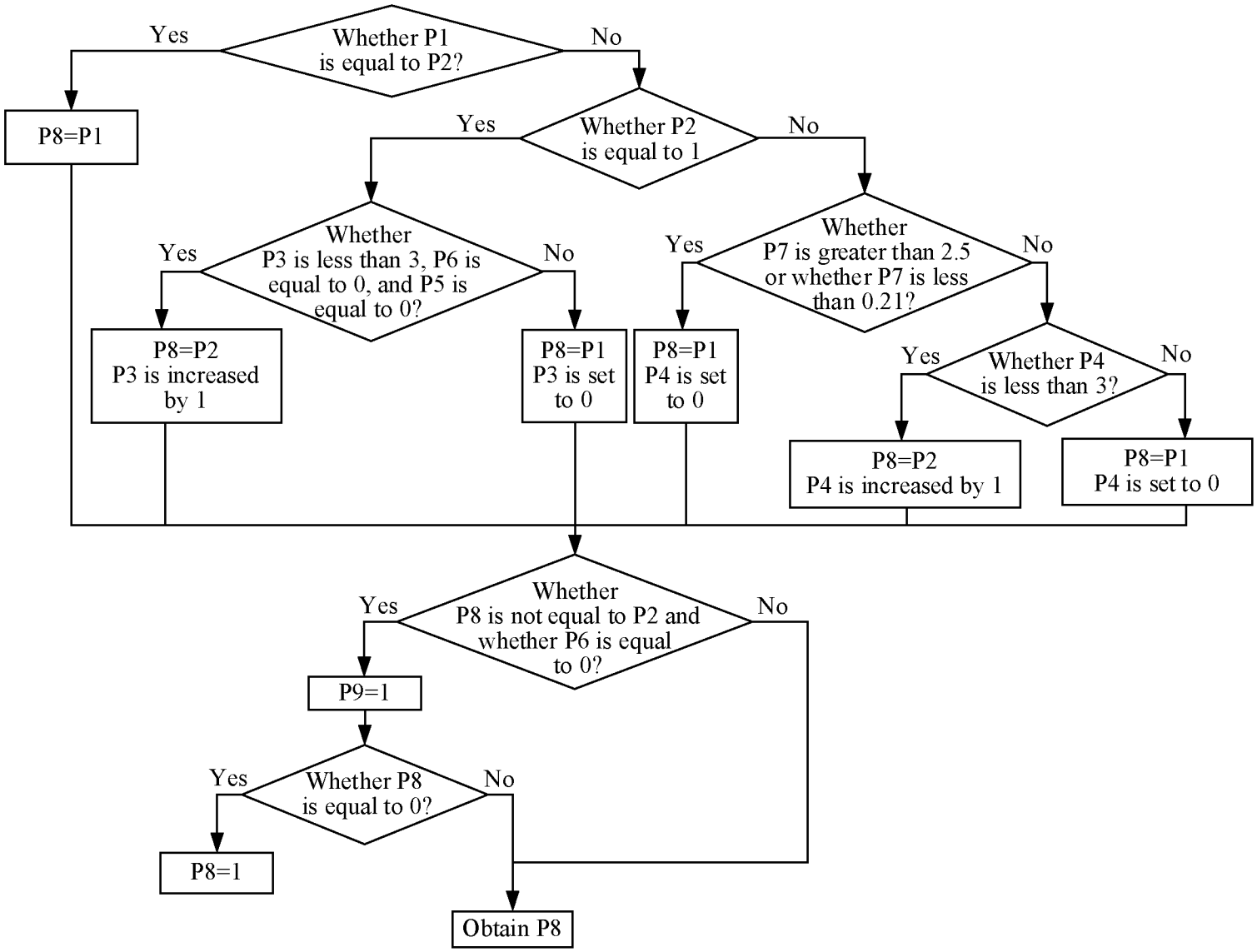
FIG. 3 is a flowchart of a specific implementation of a stereo signal encoding method according to an embodiment of this disclosure.

Referring to FIG. 3, an encoding end first determines whether P1 is equal to P2, that is, whether the initial encoding mode of the residual signal of the current frame is the same as the encoding mode of the residual signal of the previous frame. If P1=P2, it is assumed that P8 is equal to P1, that is, the initial encoding mode is kept. If P1≠P2, the encoding end continues to determine whether P2 is equal to 1. When P2=1, that is, the encoding end encodes the residual signal of the previous frame, if P3<3, P6=0, and P5=0, that is, a quantity of consecutive frames whose residual signals are encoded before the current frame is less than the first threshold, the encoding mode of the residual signal of the previous frame is not modified, and the value of the updating manner flag for the long-term smooth parameter is 0, the encoding end may determine that P8=P2, that is, assign the encoding mode of the residual signal of the previous frame to the encoding mode of the residual signal of the current frame. In this case, P3 is increased by 1. If any one of P3<3, P6=0, and P5=0 is not met, the encoding end may determine that P8=P1, that is, assign the initial encoding mode to the encoding mode of the residual signal of the current frame. In this case, P3 is set to 0. When P2=0, that is, the encoding end does not encode the residual signal of the previous frame, if P7>2.5 or P7<0.21, that is, the value of the status change parameter is greater than the third threshold or less than the second threshold, the encoding end may determine that P8=P1, and P4 is set to 0. If 0.21≤P7≤2.5 and P4<3, that is, the value of the status change parameter is greater than or equal to the second threshold, and less than or equal to the third threshold, and a quantity of consecutive frames whose residual signals are not encoded before the current frame is less than the first threshold, the encoding end may determine that P8=P2, and P4 is increased by 1. If 0.21≤P7≤2.5 and P4≥3, the encoding end may determine that P8=P1, and P4 is set to 0.

The encoding end continues to determine whether P8 is the same as P2, and whether P6 is equal to 0, that is, determine whether the encoding mode of the residual signal of the current frame is the same as the encoding mode of the residual signal of the previous frame, and whether the encoding mode of the residual signal of the previous frame is modified. If P8≠P2 and P6=0, that is, the determined encoding mode of the residual signal of the current frame is different from the encoding mode of the residual signal of the previous frame, and the encoding mode of the residual signal of the previous frame is not modified, the encoding end may determine that P9=1, that is, the current frame is a switching frame. In addition, the encoding end further determines whether P8 is equal to 0. If P8=0, the encoding end modifies P8 to make P8=1, that is, the encoding mode of the residual signal of the current frame is modified to indicate to encode the residual signal of the current frame. If P8=1, P8 is kept unmodified. If P8=P2 and/or P6=1, that is, the encoding mode of the residual signal of the current frame is the same as the encoding mode of the residual signal of the previous frame, and/or the encoding mode of the residual signal of the previous frame is modified, the encoding end does not modify the determined encoding mode of the residual signal of the current frame and keeps P8 unmodified.

Figure 4:
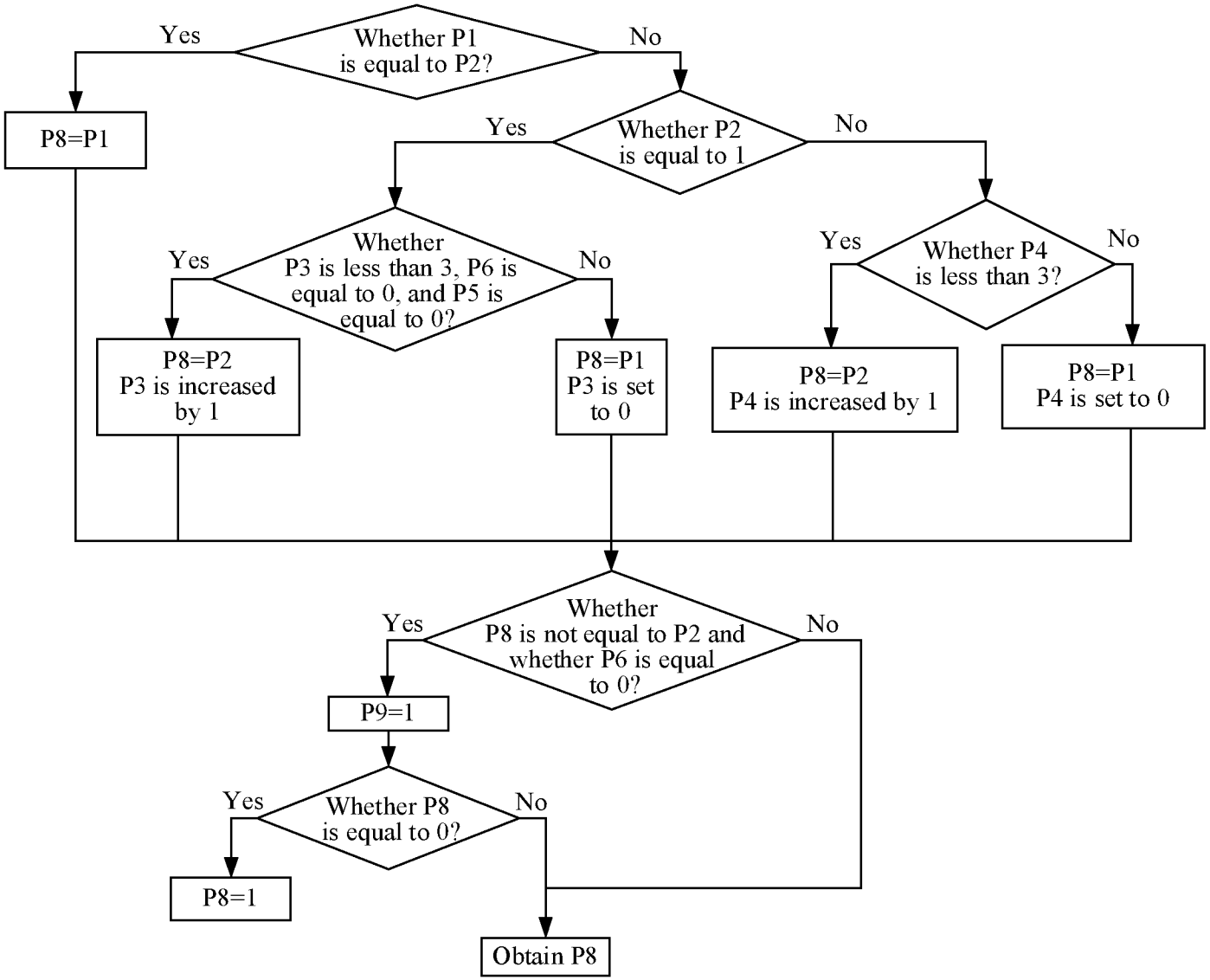
FIG. 4 is a flowchart of another specific implementation of a stereo signal encoding method according to an embodiment of this disclosure.

Referring to FIG. 4, the encoding end first determines whether P1 is equal to P2. If P1=P2, it is assumed that P8 is equal to P1. If P1≠P2, the encoding end continues to determine whether P2 is equal to 1. When P2=1, if P3<3, P6=0, and P5=0, the encoding end may determine that P8=P2, and P3 is increased by 1. If any one of P3<3, P6=0, and P5=0 is not met, the encoding end may determine that P8=P1. When P2=0, if P4<3, that is, a quantity of consecutive frames whose residual signals are not encoded before the current frame is less than the first threshold, the encoding end may determine that P8=P2, and P4 is increased by 1. If P4≥3, that is, a quantity of consecutive frames whose residual signals are not encoded before the current frame is greater than or equal to the first threshold, the encoding end may determine that P8=P1, and P4 is set to 0.

The encoding end continues to determine whether P8 is the same as P2 and whether P6 is equal to 0. If P8≠P2 and P6=0, the encoding end may determine that P9=1. In addition, the encoding end further determines whether P8 is equal to 0. If P8=0, the encoding end modifies P8 to make P8=1. If P8=1, P8 is kept unmodified. If P8=P2 and/or P6=1, the encoding end does not modify the determined encoding mode of the residual signal of the current frame and keeps P8 unmodified.

Figure 5:
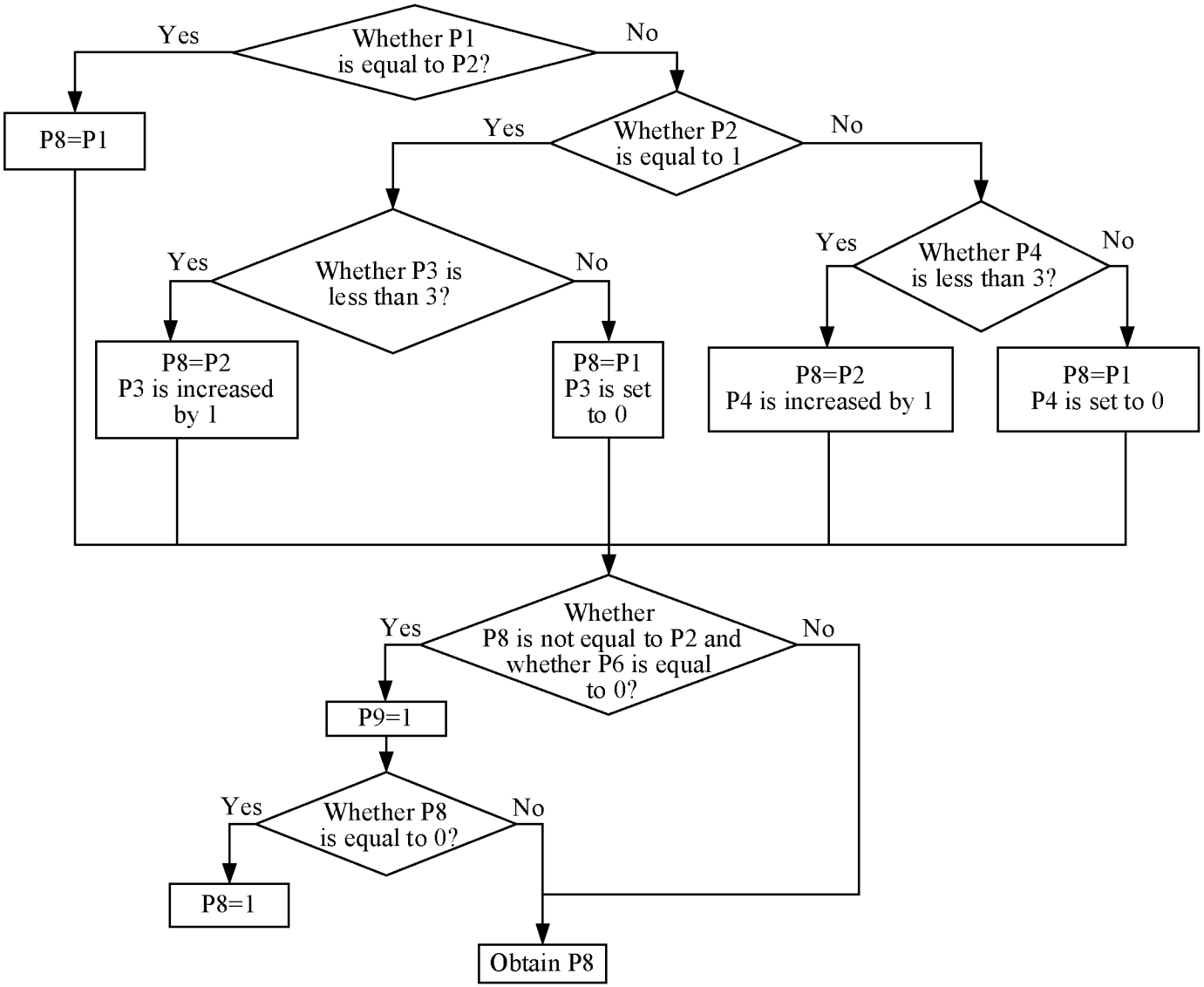
FIG. 5 is a flowchart of another specific implementation of a stereo signal encoding method according to an embodiment of this disclosure.

Referring to FIG. 5, the encoding end first determines whether P1 is equal to P2. If P1=P2, it is assumed that P8 is equal to P1. If P1≠P2, the encoding end continues to determine whether P2 is equal to 1. When P2=1, if P3<3, that is, a quantity of consecutive frames whose residual signals are encoded before the current frame is less than the first threshold, the encoding end may determine that P8=P2, and P3 is increased by 1. If P3≥3, that is, a quantity of consecutive frames whose residual signals are encoded before the current frame is greater than or equal to the first threshold, the encoding end may determine that P8=P1, and P3 is set to 0. When P2=0, if P4<3, the encoding end may determine that P8=P2, and P4 is increased by 1. If P4≥3, the encoding end may determine that P8=P1, and P4 is set to 0.

The encoding end continues to determine whether P8 is the same as P2 and whether P6 is equal to 0. If P8≠P2 and P6=0, the encoding end may determine that P9=1. In addition, the encoding end further determines whether P8 is equal to 0. If P8=0, the encoding end modifies P8 to make P8=1. If P8=1, P8 is kept unmodified. If P8=P2 and/or P6=1, the encoding end does not modify the determined encoding mode of the residual signal of the current frame and keeps P8 unmodified.

Figure 6:
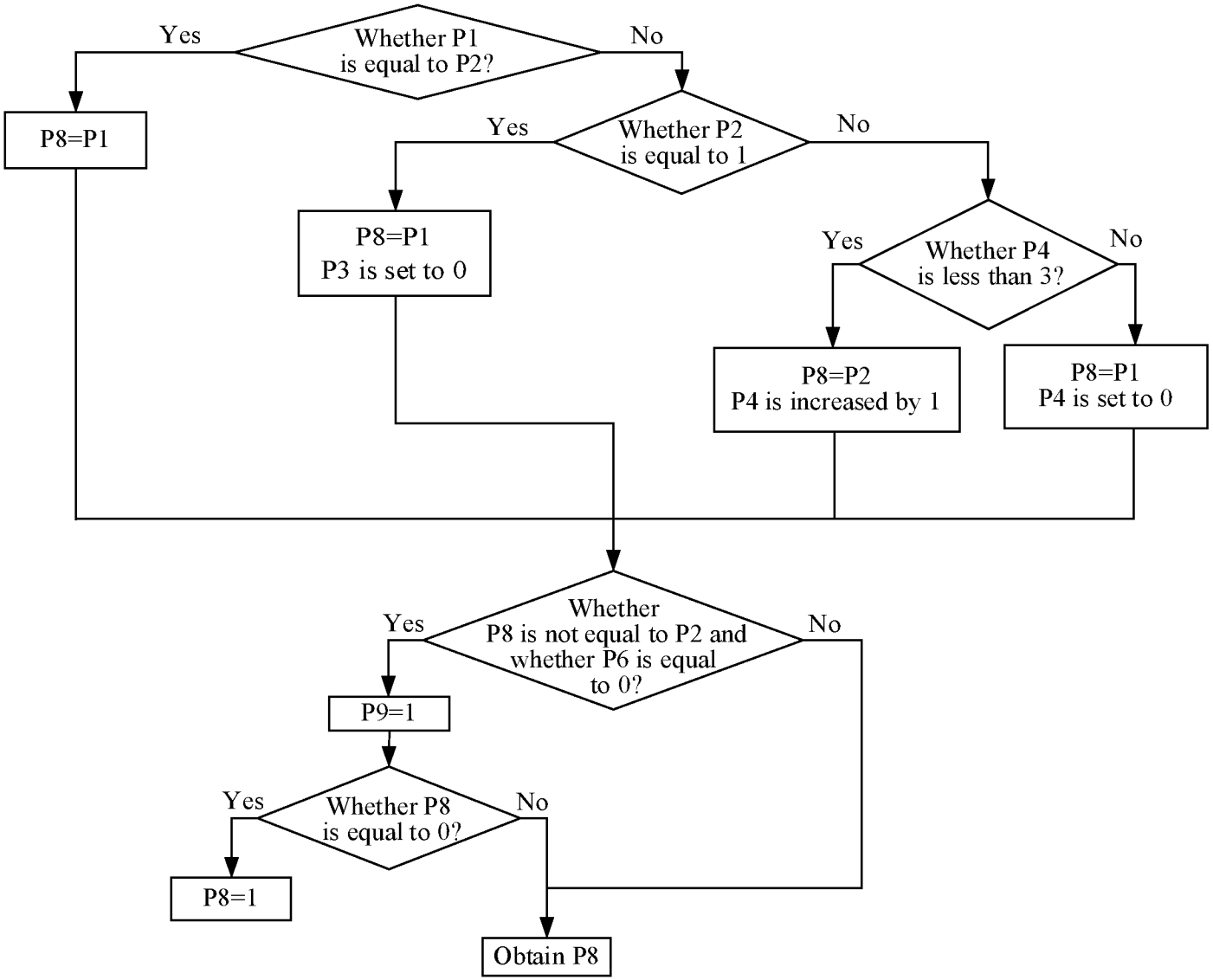
FIG. 6 is a flowchart of another specific implementation of a stereo signal encoding method according to an embodiment of this disclosure.

Referring to FIG. 6, the encoding end first determines whether P1 is equal to P2. If P1=P2, it is assumed that P8 is equal to P1. If P1≠P2, the encoding end continues to determine whether P2 is equal to 1. When P2=1, that is, the encoding mode of the residual signal of the previous frame indicates to encode the residual signal of the previous frame, the encoding end may determine that P8=P1, and P3 is set to 0. When P2=0, if P4<3, the encoding end may determine that P8=P2, and P4 is increased by 1. If P4≥3, the encoding end may determine that P8=P1, and P4 is set to 0.

The encoding end continues to determine whether P8 is the same as P2 and whether P6 is equal to 0. If P8≠P2 and P6=0, the encoding end may determine that P9=1. In addition, the encoding end further determines whether P8 is equal to 0. If P8=0, the encoding end modifies P8 to make P8=1. If P8=1, P8 is kept unmodified. If P8=P2 and/or P6=1, the encoding end does not modify the determined encoding mode of the residual signal of the current frame and keeps P8 unmodified.

It should be understood that specific examples in the embodiments of this disclosure are merely intended to help a person skilled in the art better understand the embodiments of this disclosure, but are not intended to limit the scope of the embodiments of this disclosure.

In this embodiment of this disclosure, because some factors of signals of several preceding frames, such as the encoding status, the value of the updating manner flag for the long-term smooth parameter, and the value of the status change parameter are related to the encoding mode of the residual signal of the current frame, the encoding mode that is of the residual signal of the current frame and that is determined based on at least one of encoding statuses of the signals of the several preceding frames, the value of the updating manner flag for the long-term smooth parameter, or the value of the status change parameter has relatively high accuracy, thereby better improving encoding quality of a stereo signal.

The foregoing describes in detail the method provided in the embodiments of this disclosure. Based on a same disclosure concept as the foregoing method embodiments, an embodiment of this disclosure provides an encoding apparatus configured to implement functions in the methods provided in the embodiments of this disclosure. The encoding apparatus may further include a hardware structure and/or a software module, and implement the foregoing functions in a form of a hardware structure, a software module, or a combination of a hardware structure and a software module. Whether a function in the foregoing functions is performed in a form of a hardware structure, a software structure, or a combination of a hardware structure and a software module depends on particular disclosures and design constraint conditions of the technical solution.

Figure 7:
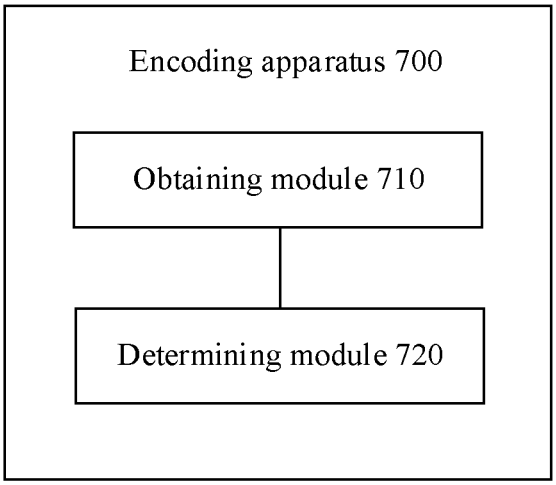
FIG. 7 is a schematic block diagram of an encoding apparatus according to an embodiment of this disclosure.

FIG. 7 is a schematic block diagram of an encoding apparatus according to an embodiment of this disclosure. It should be understood that the encoding apparatus 700 shown in FIG. 7 is merely an example. The encoding apparatus 700 in this embodiment of this disclosure may further include other modules or units, or include modules having functions similar to those of modules in FIG. 7, or does not necessarily include all the modules in FIG. 7.

An obtaining module 710 is configured to obtain indication information of an encoding mode of a residual signal of a current frame. The indication information includes at least one of an encoding status of a residual signal of a previous frame of the current frame, a value of a updating manner flag for a long-term smooth parameter of a stereo signal of the current frame, or a value of a status change parameter of a stereo signal of the current frame relative to a stereo signal of the previous frame.

A determining module 720 is configured to determine the encoding mode of the residual signal of the current frame based on the indication information that is of the encoding mode of the residual signal of the current frame and that is obtained by the obtaining module 710. The encoding mode indicates whether to encode the residual signal of the current frame.

Optionally, the encoding status that is of the residual signal of the previous frame of the current frame and that is obtained by the obtaining module 710 indicates at least one of the following cases: a quantity of consecutive frames whose residual signals are encoded before the current frame, a quantity of consecutive frames whose residual signals are not encoded before the current frame, or encoding modes of residual signals of N preceding frames of the current frame. The N preceding frames of the current frame are consecutive in time domain, and the N preceding frames of the current frame include a previous frame closely adjacent to the current frame. Herein, N is a positive integer.

Optionally, the value of the status change parameter obtained by the obtaining module 710 includes a ratio of energy of the stereo signal of the current frame to energy of an stereo signal of M preceding frames of the current frame, where the M preceding frames of the current frame are consecutive in time domain, the M preceding frames of the current frame include the previous frame closely adjacent to the current frame, and M is a positive integer, or a ratio of an amplitude of the stereo signal of the current frame to an amplitude of the stereo signal of S preceding frames of the current frame, where the S preceding frames of the current frame are consecutive in time domain, the S preceding frames of the current frame include the previous frame closely adjacent to the current frame, and S is a positive integer.

Optionally, the determining module 720 may further be configured to determine an initial encoding mode of the residual signal of the current frame. In this case, the determining module 720 may be further configured to determine the encoding mode of the residual signal of the current frame based on the initial encoding mode of the residual signal of the current frame and the indication information that is of the encoding mode of the residual signal of the current frame and that is obtained by the obtaining module 710.

Optionally, the indication information that is of the encoding mode of the residual signal of the current frame and that is obtained by the obtaining module 710 includes the encoding status of the residual signal of the previous frame of the current frame, and the encoding status of the residual signal of the previous frame of the current frame indicates the encoding modes of the residual signals of the N preceding frames of the current frame.

The determining module 720 may be further configured to, if the initial encoding mode is the same as an encoding mode of a residual signal of the previous frame closely adjacent to the current frame, determine that the encoding mode of the residual signal of the current frame is the initial encoding mode.

Optionally, the indication information that is of the encoding mode of the residual signal of the current frame and that is obtained by the obtaining module 710 includes the encoding status of the residual signal of the previous frame of the current frame and/or the value of the updating manner flag for the long-term smooth parameter, and the encoding status of the residual signal of the previous frame of the current frame indicates the quantity of consecutive frames whose residual signals are encoded before the current frame, and the encoding modes of the residual signals of the N preceding frames of the current frame.

The determining module 720 may be further configured to, if the initial encoding mode is different from an encoding mode of a residual signal of the previous frame closely adjacent to the current frame, and the encoding mode of the residual signal of the previous frame indicates to encode the residual signal of the previous frame, when a first condition is met, determine that the encoding mode of the residual signal of the current frame is the encoding mode of the residual signal of the previous frame, where the first condition includes that the quantity of consecutive frames whose residual signals are encoded before the current frame is less than a first threshold.

Optionally, the first condition further includes that the value of the updating manner flag for the long-term smooth parameter is 0, and that the encoding mode of the residual signal of the previous frame is not modified.

Optionally, the determining module 720 may further be configured to, if the first condition is not met, determine that the encoding mode of the residual signal of the current frame is the initial encoding mode.

Optionally, the indication information that is of the encoding mode of the residual signal of the current frame and that is obtained by the obtaining module 710 includes the encoding status of the residual signal of the previous frame of the current frame and/or the value of the status change parameter, and the encoding status of the residual signal of the previous frame of the current frame indicates the quantity of consecutive frames whose residual signals are not encoded before the current frame, and the encoding modes of the residual signals of the N preceding frames of the current frame.

The determining module 720 may be further configured to, if the initial encoding mode is different from an encoding mode of a residual signal of the previous frame closely adjacent to the current frame, and the encoding mode of the residual signal of the previous frame indicates not to encode the residual signal of the previous frame, when a second condition is met, determine that the encoding mode of the residual signal of the current frame is the encoding mode of the residual signal of the previous frame, where the second condition includes that the quantity of consecutive frames whose residual signals are not encoded before the current frame is less than a first threshold.

Optionally, the second condition further includes that the value of the status change parameter is greater than or equal to a second threshold, and less than or equal to a third threshold.

Optionally, the determining module 720 may further be configured to, if the second condition is not met, determine that the encoding mode of the residual signal of the current frame is the initial encoding mode.

Optionally, the encoding apparatus may further include a modification module 730 configured to modify, based on the indication information that is of the encoding mode of the residual signal of the current frame and that is obtained by the obtaining module 710, the encoding mode that is of the residual signal of the current frame and that is determined by the determining module 720.

Optionally, the indication information that is of the encoding mode of the residual signal of the current frame and that is obtained by the obtaining module 710 includes the encoding status of the residual signal of the previous frame of the current frame, and the encoding status of the residual signal of the previous frame of the current frame indicates the encoding modes of the residual signals of the N preceding frames of the current frame.

The modification module 730 may be further configured to, if the encoding mode that is of the residual signal of the current frame and that is determined by the determining module 720 is different from the encoding mode of the residual signal of the previous frame closely adjacent to the current frame, and the encoding mode of the residual signal of the previous frame is not modified, determine that the encoding mode of the residual signal of the current frame indicates to encode the residual signal of the current frame.

Optionally, the determining module 720 may be further configured to determine the initial encoding mode based on energy of a downmixed signal of the current frame and energy of the residual signal of the current frame.

Figure 8:
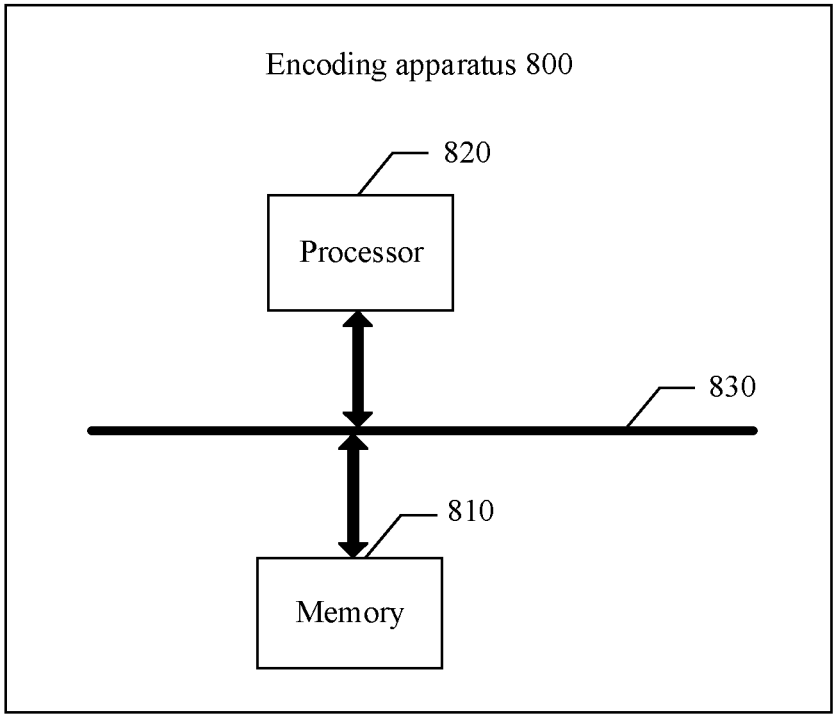
FIG. 8 is a schematic block diagram of an encoding apparatus according to an embodiment of this disclosure.

As shown in FIG. 8, an embodiment of this disclosure provides an encoding apparatus 800 configured to implement functions of the encoding end in the foregoing methods. The encoding apparatus 800 may be a chip system. In this embodiment of this disclosure, the chip system may include a chip, or may include a chip and another discrete device. The encoding apparatus 800 includes a memory 810 and a processor 820.

The memory 810 is configured to store a program instruction.

The processor 820 is configured to invoke and execute the program instruction stored in the memory 810. When executing the program instruction in the memory 810, the processor 820 is further configured to obtain indication information of an encoding mode of a residual signal of a current frame, where the indication information includes at least one of an encoding status of a residual signal of a previous frame of the current frame, a value of a updating manner flag for a long-term smooth parameter of a stereo signal of the current frame, or a value of a status change parameter of a stereo signal of the current frame relative to a stereo signal of the previous frame, and determine the encoding mode of the residual signal of the current frame based on the obtained indication information of the encoding mode of the residual signal of the current frame, where the encoding mode indicates whether to encode the residual signal of the current frame.

Optionally, the encoding status that is of the residual signal of the previous frame of the current frame and that is obtained by the processor 820 indicates at least one of the following cases a quantity of consecutive frames whose residual signals are encoded before the current frame, a quantity of consecutive frames whose residual signals are not encoded before the current frame, or encoding modes of residual signals of N preceding frames of the current frame. The N preceding frames of the current frame are consecutive in time domain, and the N preceding frames of the current frame include a previous frame closely adjacent to the current frame. Herein, N is a positive integer.

Optionally, the value of the status change parameter obtained by the processor 820 includes a ratio of energy of the stereo signal of the current frame to energy of the stereo signal of M preceding frames of the current frame, where the M preceding frames of the current frame are consecutive in time domain, the M preceding frames of the current frame include the previous frame closely adjacent to the current frame, and M is a positive integer, or a ratio of an amplitude of the stereo signal of the current frame to an amplitude of the stereo signal of S preceding frames of the current frame, where the S preceding frames of the current frame are consecutive in time domain, the S preceding frames of the current frame include the previous frame closely adjacent to the current frame, and S is a positive integer.

Optionally, the processor 820 is further configured to determine an initial encoding mode of the residual signal of the current frame, and determine the encoding mode of the residual signal of the current frame based on the indication information of the encoding mode of the residual signal of the current frame and the initial encoding mode of the residual signal of the current frame.

Optionally, the indication information that is of the encoding mode of the residual signal of the current frame and that is obtained by the processor 820 includes the encoding status of the residual signal of the previous frame of the current frame, and the encoding status of the residual signal of the previous frame of the current frame indicates the encoding modes of the residual signals of the N preceding frames of the current frame.

The processor 820 is further configured to, if the initial encoding mode is the same as an encoding mode of a residual signal of the previous frame closely adjacent to the current frame, determine that the encoding mode of the residual signal of the current frame is the initial encoding mode.

Optionally, the indication information that is of the encoding mode of the residual signal of the current frame and that is obtained by the processor 820 includes the encoding status of the residual signal of the previous frame of the current frame and/or the value of the updating manner flag for the long-term smooth parameter, and the encoding status of the residual signal of the previous frame of the current frame indicates the quantity of consecutive frames whose residual signals are encoded before the current frame, and the encoding modes of the residual signals of the N preceding frames of the current frame.

The processor 820 is further configured to, if the initial encoding mode is different from an encoding mode of a residual signal of the previous frame closely adjacent to the current frame, and the encoding mode of the residual signal of the previous frame indicates to encode the residual signal of the previous frame, when a first condition is met, determine that the encoding mode of the residual signal of the current frame is the encoding mode of the residual signal of the previous frame, where the first condition includes that the quantity of consecutive frames whose residual signals are encoded before the current frame is less than a first threshold.

Optionally, the first condition further includes that the value of the updating manner flag for the long-term smooth parameter is 0, and that the encoding mode of the residual signal of the previous frame is not modified.

Optionally, the processor 820 is further configured to, if the first condition is not met, determine that the encoding mode of the residual signal of the current frame is the initial encoding mode.

Optionally, the indication information that is of the encoding mode of the residual signal of the current frame and that is obtained by the processor 820 includes the encoding status of the residual signal of the previous frame of the current frame and/or the value of the status change parameter, and the encoding status of the residual signal of the previous frame of the current frame indicates the quantity of consecutive frames whose residual signals are not encoded before the current frame, and the encoding modes of the residual signals of the N preceding frames of the current frame.

The processor 820 is further configured to, if the initial encoding mode is different from an encoding mode of a residual signal of the previous frame closely adjacent to the current frame, and the encoding mode of the residual signal of the previous frame indicates not to encode the residual signal of the previous frame, when a second condition is met, determine that the encoding mode of the residual signal of the current frame is the encoding mode of the residual signal of the previous frame, where the second condition includes that the quantity of consecutive frames whose residual signals are not encoded before the current frame is less than a first threshold.

Optionally, the second condition further includes that the value of the status change parameter is greater than or equal to a second threshold, and less than or equal to a third threshold.

Optionally, the processor 820 is further configured to, if the second condition is not met, determine that the encoding mode of the residual signal of the current frame is the initial encoding mode.

Optionally, the processor 820 is further configured to modify the encoding mode of the residual signal of the current frame based on the indication information of the encoding mode of the residual signal of the current frame.

Optionally, the indication information that is of the encoding mode of the residual signal of the current frame and that is obtained by the processor 820 includes the encoding status of the residual signal of the previous frame of the current frame, and the encoding status of the residual signal of the previous frame of the current frame indicates the encoding modes of the residual signals of the N preceding frames of the current frame.

The processor 820 is further configured to, if the encoding mode of the residual signal of the current frame is different from the encoding mode of the residual signal of the previous frame closely adjacent to the current frame, and the encoding mode of the residual signal of the previous frame is not modified, determine that the encoding mode of the residual signal of the current frame indicates to encode the residual signal of the current frame.

Optionally, the processor 820 is further configured to determine the initial encoding mode based on energy of a downmixed signal of the current frame and energy of the residual signal of the current frame.

In this embodiment of this disclosure, a specific connection medium between the processor 820 and the memory 810 is not limited. In this embodiment of this disclosure, the memory 810 and the processor 820 are connected using a bus 830 in FIG. 8. The bus is indicated using a bold line in FIG. 8. A manner of connection between other components is merely an example for description, and imposes no limitation. The bus may be classified into an address bus, a data bus, a control bus, and the like. For ease of representation, only one thick line is used to represent the bus in FIG. 8, but this does not mean that there is only one bus or only one type of bus.

The processor in the embodiments of this disclosure may be a central processing unit (CPU), or may further be another general purpose processor, a digital signal processor (DSP), an application specific integrated circuit (ASIC), a field-programmable gate array (FPGA), or another programmable logical device, discrete gate or transistor logical device, discrete hardware component, or the like. The general purpose processor may be a microprocessor, or the processor may be any conventional processor or the like.

The memory in the embodiments of this disclosure may be a volatile memory or a nonvolatile memory, or may include a volatile memory and a nonvolatile memory. The nonvolatile memory may be a read-only memory (ROM), a programmable ROM (PROM), an erasable PROM (EPROM), an electrically EPROM (EEPROM), or a flash memory. The volatile memory may be a random-access memory (RAM), used as an external cache. Through example but not limitative description, many forms of RAMs may be used, for example, a static RAM (SRAM), a dynamic RAM (DRAM), a synchronous DRAM (SDRAM), a double data rate (DDR) SDRAM, an enhanced SDRAM (ESDRAM), a synchlink DRAM (SLDRAM), and a direct rambus (DR) RAM.

It should be understood that the stereo signal encoding method in the embodiments of this disclosure may be performed by a terminal device or a network device in FIG. 9 to FIG. 14. In addition, the encoding apparatus in this embodiment of this disclosure may further be disposed in the terminal device or the network device in FIG. 9 to FIG. 14. Further, the encoding apparatus in this embodiment of this disclosure may be a stereo encoder in the terminal device or the network device in FIG. 9 to FIG. 14.

Figure 9:
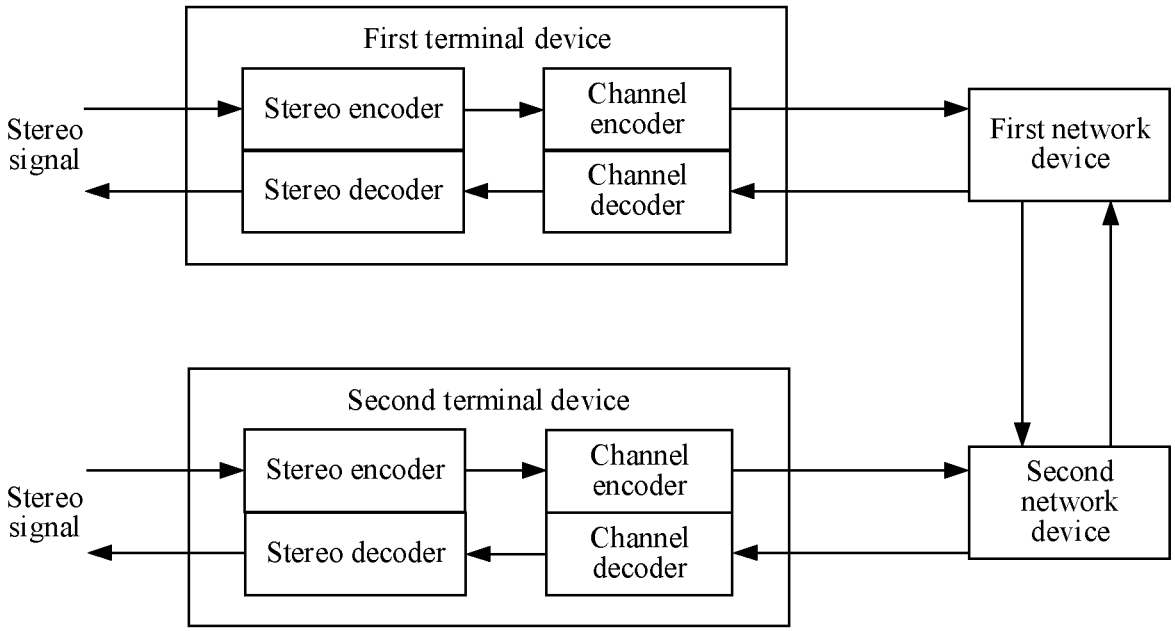
FIG. 9 is a schematic diagram of a terminal device according to an embodiment of this disclosure.

As shown in FIG. 9, in audio communication, a stereo encoder in a first terminal device performs stereo encoding on a collected stereo signal, and a channel encoder in the first terminal device may then perform channel encoding on a bitstream obtained by the stereo encoder. Then, data obtained after the channel encoding performed by the first terminal device is transmitted to a second terminal device using a first network device and a second network device. After the second terminal device receives the data from the second network device, a channel decoder in the second terminal device performs channel decoding to obtain an encoded bitstream of a stereo signal, and then a stereo decoder of the second terminal device recovers the stereo signal through decoding such that the terminal device plays back the stereo signal. In this way, audio communication is completed among different terminal devices.

It should be understood that in FIG. 9, the second terminal device may also encode a collected stereo signal, and finally transmit, to the first terminal device using the second network device and the first network device, data finally obtained through encoding, and the first terminal device performs channel decoding and stereo decoding on the data to obtain the stereo signal.

In FIG. 9, the first network device and the second network device may be wireless network communications devices or wired network communications devices. Communication may be performed between the first network device and the second network device using a data channel.

The first terminal device or the second terminal device in FIG. 9 may perform the stereo signal encoding and decoding methods in this embodiment of this disclosure. An encoding apparatus and a decoding apparatus in this embodiment of this disclosure may be respectively the stereo encoder and the stereo decoder in the first terminal device or the second terminal device.

Figure 10:
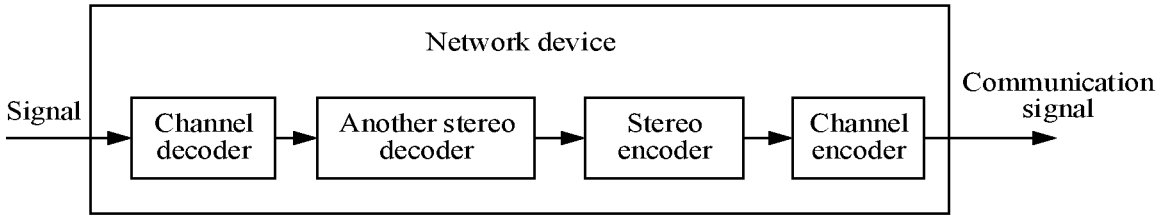
FIG. 10 is a schematic diagram of a network device according to an embodiment of this disclosure.

In audio communication, the network device may implement transcoding of an audio signal in an encoding/a decoding format. As shown in FIG. 10, if an encoding/a decoding format of a signal received by a network device is an encoding/a decoding format corresponding to another stereo decoder, a channel decoder in the network device performs channel decoding on the received signal to obtain an encoded bitstream corresponding to the other stereo decoder. the other stereo decoder decodes the encoded bitstream to obtain a stereo signal. A stereo encoder then encodes the stereo signal to obtain an encoded bitstream of the stereo signal. Finally, the channel encoder performs channel encoding on the encoded bitstream of the stereo signal to obtain a final signal (the signal may be transmitted to a terminal device or another network device). It should be understood that the encoding/decoding format corresponding to the stereo encoder in FIG. 10 is different from the encoding/decoding format corresponding to the other stereo decoder. It is assumed that the encoding/decoding format corresponding to the other stereo decoder is a first encoding/decoding format, and the encoding/decoding format corresponding to the stereo encoder is a second encoding/decoding format. In this case, in FIG. 10, the stereo signal is converted from the first encoding/decoding format to the second encoding/decoding format using the network device.

Figure 11:
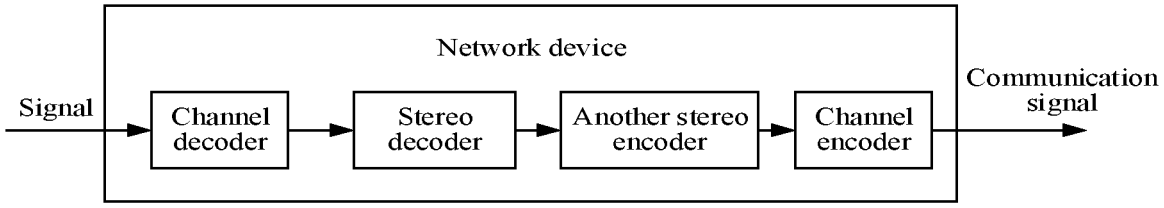
FIG. 11 is a schematic diagram of a network device according to an embodiment of this disclosure.

Similarly, as shown in FIG. 11, if an encoding/a decoding format of a signal received by a network device is the same as an encoding/a decoding format corresponding to a stereo decoder, after a channel decoder in the network device performs channel decoding to obtain an encoded bitstream of a stereo signal, the stereo decoder may decode the encoded bitstream of the stereo signal to obtain the stereo signal. Then, another stereo encoder encodes the stereo signal based on another encoding/decoding format, to obtain an encoded bitstream corresponding to the other stereo encoder. Finally, the channel encoder performs channel encoding on the encoded bitstream corresponding to the other stereo encoder, to obtain a final signal (the signal may be transmitted to a terminal device or another network device). The encoding/decoding format corresponding to the stereo decoder in FIG. 11 is different from the encoding/decoding format corresponding to the other stereo encoder. This is the same as the case in FIG. 10. If the encoding/decoding format corresponding to the other stereo encoder is a first encoding/decoding format, and the encoding/decoding format corresponding to the stereo decoder is a second encoding/decoding format, in FIG. 11, the stereo signal is converted from the second encoding/decoding format to the first encoding/decoding format using the network device.

In FIG. 10 and FIG. 11, a stereo encoder/decoder and another stereo encoder/decoder respectively correspond to different encoding/decoding formats. Therefore, transcoding of a stereo signal in an encoding/a decoding format is implemented through processing performed by the stereo encoder/decoder and the other stereo encoder/decoder.

It should further be understood that the stereo encoder in FIG. 10 can implement the stereo signal encoding method in the embodiments of this disclosure, and the stereo decoder in FIG. 11 can implement the stereo signal decoding method in the embodiments of this disclosure. The encoding apparatus in the embodiments of this disclosure may be the stereo encoder in the network device in FIG. 10, and the decoding apparatus in the embodiments of this disclosure may be the stereo decoder in the network device in FIG. 11. In addition, the network device in FIG. 10 and FIG. 11 may be a wireless network communications device or a wired network communications device.

Figure 12:
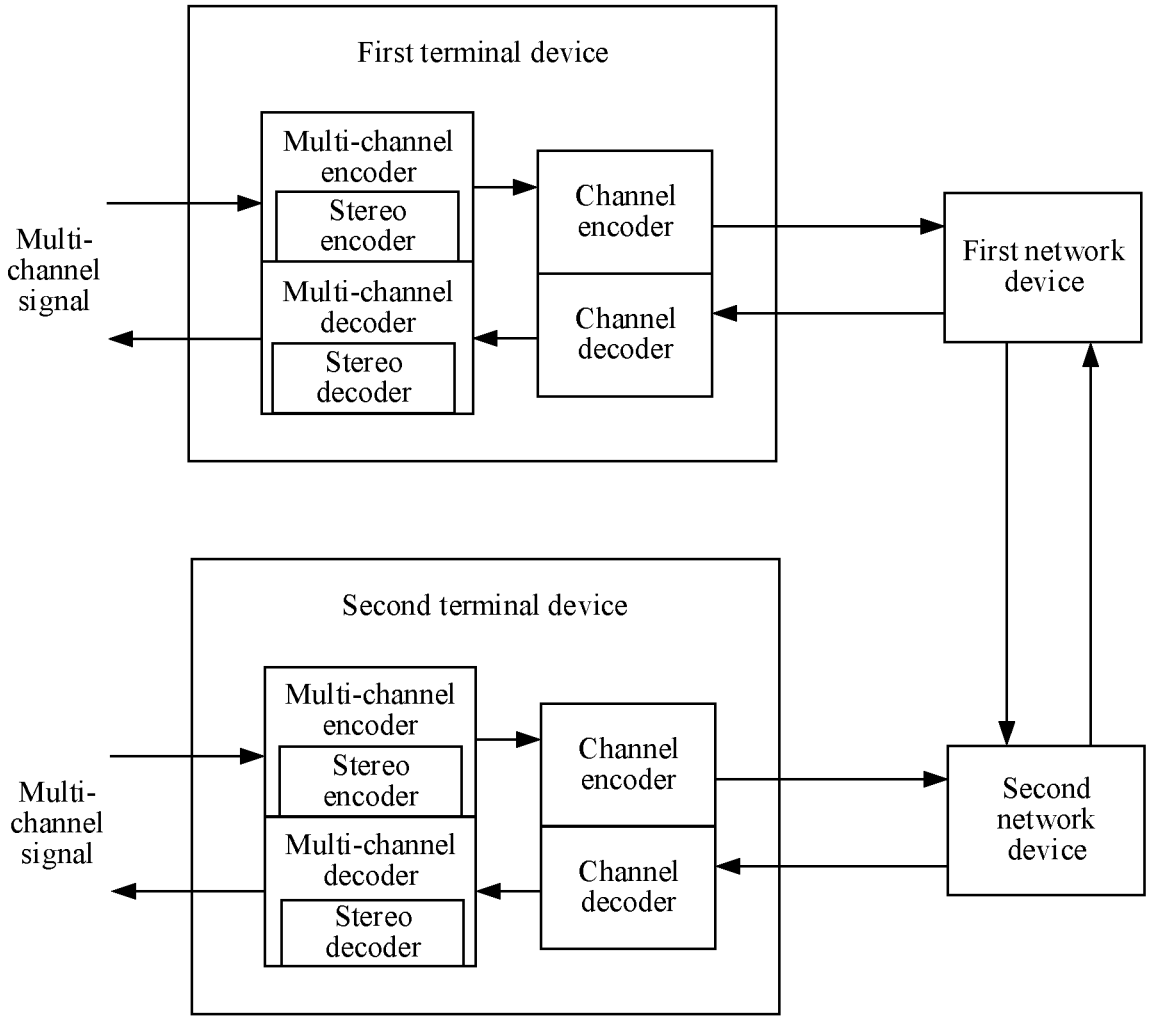
FIG. 12 is a schematic diagram of a terminal device according to an embodiment of this disclosure.

As shown in FIG. 12, in audio communication, a stereo encoder in a multi-channel encoder in a first terminal device performs stereo encoding on a stereo signal generated from a collected multi-channel signal. A bitstream obtained by the multi-channel encoder includes a bitstream obtained by the stereo encoder. A channel encoder in the first terminal device may perform channel encoding on the bitstream obtained by the multi-channel encoder. Then, data obtained after the channel encoding performed by the first terminal device is transmitted to a second terminal device using a first network device and a second network device. After the second terminal device receives the data from the second network device, a channel decoder in the second terminal device performs channel decoding to obtain an encoded bitstream of the multi-channel signal. The encoded bitstream of the multi-channel signal includes an encoded bitstream of the stereo signal. Then, a stereo decoder in a multi-channel decoder in the second terminal device recovers the stereo signal through decoding, and the multi-channel decoder obtains the multi-channel signal through decoding based on the recovered stereo signal such that the second terminal device plays back the multi-channel signal. In this way, audio communication is completed among different terminal devices.

It should be understood that, in FIG. 12, the second terminal device may alternatively encode a collected multi-channel signal (a stereo encoder in a multi-channel encoder of the second terminal device performs stereo encoding on a stereo signal generated from the collected multi-channel signal, and then a channel encoder in the second terminal device performs channel encoding on a bitstream obtained by the multi-channel encoder), and finally, transmit the encoded signal to the first terminal device using the second network device and the first network device such that the first terminal device obtains the multi-channel signal through channel decoding and multi-channel decoding.

In FIG. 12, the first network device and the second network device may be wireless network communications devices or wired network communications devices. Communication may be performed between the first network device and the second network device using a data channel.

The first terminal device or the second terminal device in FIG. 12 may perform the stereo signal encoding and decoding methods in the embodiments of this disclosure. In addition, the encoding apparatus in the embodiments of this disclosure may be the stereo encoder in the first terminal device or the second terminal device, and the decoding apparatus in the embodiments of this disclosure may be the stereo decoder in the first terminal device or the second terminal device.

Figure 13:
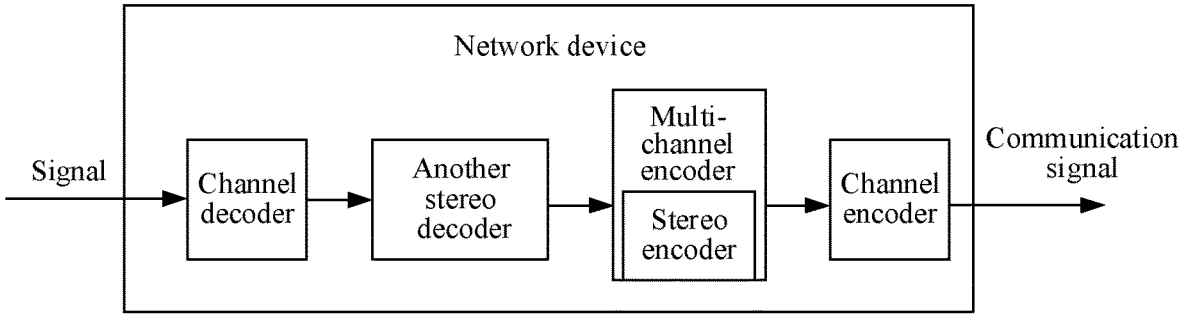
FIG. 13 is a schematic diagram of a network device according to an embodiment of this disclosure.

In audio communication, the network device may implement transcoding of an audio signal in an encoding/a decoding format. As shown in FIG. 13, if an encoding/a decoding format of a signal received by a network device is an encoding/a decoding format corresponding to another multi-channel decoder, a channel decoder in the network device performs channel decoding on the received signal to obtain an encoded bitstream corresponding to the other multi-channel decoder. the other multi-channel decoder decodes the encoded bitstream to obtain a multi-channel signal. A multi-channel encoder then encodes the multi-channel signal to obtain an encoded bitstream of the multi-channel signal. A stereo encoder in the multi-channel encoder performs stereo encoding on a stereo signal generated from the multi-channel signal, to obtain an encoded bitstream of the stereo signal. The encoded bitstream of the multi-channel signal includes the encoded bitstream of the stereo signal. Finally, the channel encoder performs channel encoding on the encoded bitstream to obtain a final signal (the signal may be transmitted to a terminal device or another network device).

Figure 14:
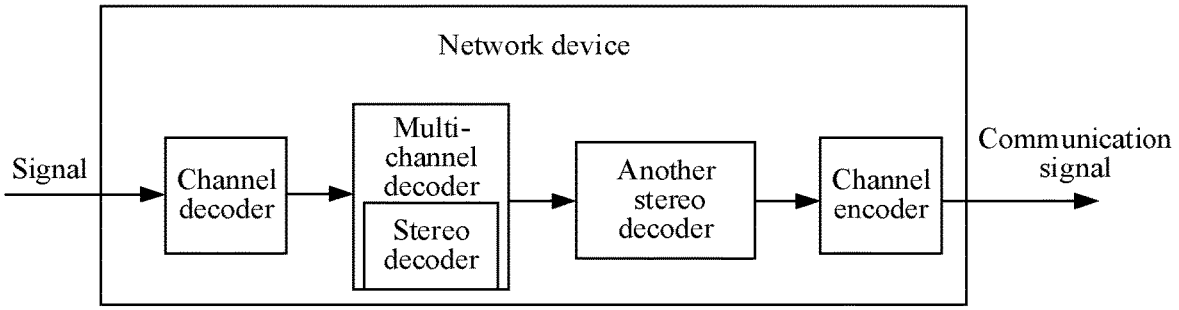
FIG. 14 is a schematic diagram of a network device according to an embodiment of this disclosure.

Similarly, as shown in FIG. 14, if an encoding/a decoding format of a signal received by a network device is the same as an encoding/a decoding format corresponding to a multi-channel decoder, after a channel decoder in the network device performs channel decoding to obtain an encoded bitstream of a multi-channel signal, the multi-channel decoder may decode the encoded bitstream of the multi-channel signal to obtain the multi-channel signal. A stereo decoder in the multi-channel decoder performs stereo decoding on an encoded bitstream of a stereo signal in the encoded bitstream of the multi-channel signal. Then, another multi-channel encoder encodes the multi-channel signal based on another encoding/decoding format, to obtain an encoded bitstream of the multi-channel signal corresponding to the other multi-channel encoder. Finally, the channel encoder performs channel encoding on the encoded bitstream corresponding to the other multi-channel encoder, to obtain a final signal (the signal may be transmitted to a terminal device or another network device).

It should be understood that, in FIG. 13 and FIG. 14, the multi-channel encoder/decoder and the other multi-channel encoder/decoder respectively correspond to different encoding/decoding formats. For example, in FIG. 13, the encoding/decoding format corresponding to the other stereo decoder is a first encoding/decoding format, and the encoding/decoding format corresponding to the multi-channel encoder is a second encoding/decoding format. In this case, in FIG. 13, the stereo signal is converted from the first encoding/decoding format to the second encoding/decoding format using the network device. Similarly, in FIG. 14, it is assumed that the encoding/decoding format corresponding to the multi-channel decoder is a second encoding/decoding format, and the encoding/decoding format corresponding to the other stereo encoder is a first encoding/decoding format. In this case, in FIG. 14, the stereo signal is converted from the second encoding/decoding format to the first encoding/decoding format using the network device. Therefore, transcoding is implemented for the encoding/decoding format of the stereo signal through processing performed by the multi-channel encoder/decoder and the other multi-channel encoder/decoder.

It should further be understood that the stereo encoder in FIG. 13 can implement the stereo signal encoding method in this disclosure, and the stereo decoder in FIG. 14 can implement the stereo signal decoding method in this disclosure. The encoding apparatus in the embodiments of this disclosure may be the stereo encoder in the network device in FIG. 13, and the decoding apparatus in the embodiments of this disclosure may be the stereo decoder in the network device in FIG. 14. In addition, the network device in FIG. 13 and FIG. 14 may be further a wireless network communications device or a wired network communications device.

This disclosure further provides a chip. The chip includes a processor and a communications interface. The communications interface is configured to communicate with an external component, and the processor is configured to perform the stereo signal encoding method according to the embodiment of this disclosure.

Optionally, in an implementation, the chip may further include a memory. The memory stores an instruction. The processor is configured to execute the instruction stored in the memory. When executing the instruction, the processor is configured to perform the stereo signal encoding method according to the embodiment of this disclosure.

Optionally, in an implementation, the chip is integrated into a terminal device or a network device.

This disclosure provides a computer-readable storage medium. The computer-readable storage medium stores program code for a device to execute. The program code includes an instruction used to perform the stereo signal encoding method in the embodiment of this disclosure.

It may be clearly understood by a person skilled in the art that, for the purpose of convenient and brief description, for a detailed working process of the foregoing system, apparatus, and unit, refer to a corresponding process in the foregoing method embodiments, and details are not described herein again.

In the several embodiments provided in this disclosure, it should be understood that the disclosed system, apparatus, and method may be implemented in other manners. For example, the described apparatus embodiment is merely an example. For example, division into units is merely logical function division and may be other division in an actual implementation. For example, a plurality of units or components may be combined or integrated into another system, or some features may be ignored or not performed. In addition, the displayed or discussed mutual couplings or direct couplings or communication connections may be implemented using some interfaces. The indirect couplings or communication connections between the apparatuses or units may be implemented in electronic, mechanical, or other forms.

The units described as separate parts may or may not be physically separate, and parts displayed as units may or may not be physical units, may be located in one position, or may be distributed on a plurality of network units. Some or all of the units may be selected based on actual requirements to achieve the objectives of the solutions of the embodiments.

In addition, functional units in the embodiments of this disclosure may be integrated into one processing unit, or each of the units may exist alone physically, or two or more units are integrated into one unit.

The sequence numbers of the foregoing processes do not mean execution sequences in various embodiments of this disclosure. The execution sequences of the processes should be determined according to functions and internal logic of the processes, and should not be construed as any limitation on the implementation processes of the embodiments of this disclosure.

All or some of the foregoing methods in the embodiments of this disclosure may be implemented by means of software, hardware, firmware, or any combination thereof. When software is used to implement the embodiments, the embodiments may be implemented completely or partially in a form of a computer program product. The computer program product includes one or more computer instructions. When the computer program instructions are loaded and executed on the computer, the procedure or functions according to the embodiments of this disclosure are all or partially generated. The computer may be a general-purpose computer, a dedicated computer, a computer network, a network device, a user device, or other programmable apparatuses. The computer instructions may be stored in a computer-readable storage medium or may be transmitted from a computer-readable storage medium to another computer-readable storage medium. For example, the computer instructions may be transmitted from a website, computer, server, or data center to another website, computer, server, or data center in a wired (for example, a coaxial cable, an optical fiber, or a digital subscriber line (digital subscriber line, DSL)) or wireless (for example, infrared, radio, or microwave) manner. The computer-readable storage medium may be any usable medium accessible by a computer, or a data storage device, such as a server or a data center, integrating one or more usable media. The usable medium may be a magnetic medium (for example, a floppy disk, a hard disk, or a magnetic tape), an optical medium (for example, a digital versatile disc (DVD)), a semiconductor medium (for example, a solid-state drive (SSD)), or the like.

The foregoing descriptions are merely specific implementations of this disclosure, but are not intended to limit the protection scope of this disclosure. Any variation or replacement readily figured out by a person skilled in the art within the technical scope disclosed in this disclosure shall fall within the protection scope of this disclosure. Therefore, the protection scope of this disclosure shall be subject to the protection scope of the claims.

When the functions are implemented in the form of a software functional unit and sold or used as an independent product, the functions may be stored in a computer-readable storage medium. Based on such an understanding, the technical solutions of this disclosure essentially, or the part contributing to the other approaches, or some of the technical solutions may be implemented in a form of a software product. The software product is stored in a storage medium, and includes several instructions for instructing a computer device (which may be a personal computer, a server, or a network device) to perform all or some of the steps of the methods described in the embodiments of this disclosure. The foregoing storage medium includes any medium that can store program code, such as a Universal Serial Bus (USB) flash drive, a removable hard disk, a ROM, a RAM, a magnetic disk, or an optical disc.

The foregoing descriptions are merely specific implementations of this disclosure, but are not intended to limit the protection scope of this disclosure. Any variation or replacement readily figured out by a person skilled in the art within the technical scope disclosed in this disclosure shall fall within the protection scope of this disclosure. Therefore, the protection scope of this disclosure shall be subject to the protection scope of the claims.

What is claimed is:

1. A method comprising:

determining a downmixed audio signal of a current frame;

determining a first residual audio signal of the current frame;

determining an energy relationship between the downmixed audio signal of the current frame and the residual audio signal of the current frame;

determining an initial encoding mode of the current frame based on the energy relationship;

obtaining indication information of a first encoding mode of the first residual audio signal of the current frame, wherein the first encoding mode indicates whether to encode the first residual audio signal or to not encode the first residual audio signal, and wherein the indication information comprises at least one of an encoding status of one or more second residual audio signals of one of more first previous frames of the current frame, a first value of an updating manner flag for a long-term smooth parameter of a first stereo audio signal of the current frame, or a second value of a status change parameter of the first stereo audio signal relative to one or more second stereo audio signals of the one or more first previous frames of the current frame;

determining the first encoding mode based on the indication information and the initial encoding mode; and selectively performing encoding of the first residual audio signal according to the first encoding mode.

2. The method of claim 1, wherein the encoding status indicates at least one of:

a first quantity of first consecutive frames previous to the current frame, wherein residual audio signals of all of the first consecutive frames are encoded;

a second quantity of second consecutive frames previous to the current frame, wherein residual audio signals of all of the second consecutive frames are not encoded; or encoding modes of residual audio signals of N frames previous to the current frame, wherein the N frames are consecutive in a time domain, and wherein N is a positive integer.

3. The method of claim 2, wherein the encoding status indicates the encoding modes, and wherein the method further comprises determining that the first encoding mode is the initial encoding mode when the initial encoding mode is the same as a second encoding mode of the one or more second residual audio signals of the one or more first previous frames.

4. The method of claim 2, wherein the indication information comprises the encoding status or the first value, wherein the encoding status indicates the first quantity and the encoding modes, wherein the method further comprises determining that the first encoding mode is a second encoding mode of the one or more second residual audio signals when the initial encoding mode is different from the second encoding mode, wherein the second encoding mode indicates to encode the one or more second residual audio signals and that a first condition is met, and wherein the first condition comprises at least one of:

the first quantity is less than a first threshold;

the first value is zero; or the second encoding mode is not modified.

5. The method of claim 2, wherein the indication information comprises the encoding status or the second value, wherein the encoding status indicates the second quantity and the encoding modes, wherein the method further comprises determining that the first encoding mode is a second encoding mode of the one or more second residual audio signals when the initial encoding mode is different from the second encoding mode, wherein the second encoding mode indicates not to encode the one or more second residual audio signals and that a second condition is met, and wherein the second condition comprises at least one of:

the second quantity is less than a first threshold; or the second value is greater than or equal to a second threshold and less than or equal to a third threshold.

6. The method of claim 2, further comprising modifying, subsequent to determining the first encoding mode, the first encoding mode based on the indication information.

7. The method of claim 6, wherein the encoding status indicates the encoding modes, and wherein the method further comprises determining that the first encoding mode indicates to encode the first residual audio signal when the first encoding mode is different from a second encoding mode of the one or more second residual audio signals and the second encoding mode of the one or more second residual audio signals is not modified.

8. The method of claim 1, wherein the one or more first previous frames are M frames previous to the current frame and are consecutive in a time domain, wherein the second value comprises a first ratio of a first energy of the first stereo audio signal to a second energy of the one or more second stereo audio signals, and wherein M is a positive integer; or wherein the one or more first previous frames are S frames previous to the current frame and are consecutive in the time domain, wherein the second value comprises a second ratio of a first amplitude of the first stereo audio signal to a second amplitude of the one or more second stereo audio signals, and wherein S is a positive integer.

9. The method of claim 1, wherein the initial encoding mode is different than the first encoding mode.

10. An apparatus comprising:

a memory configured to store computer-executable instructions; and a processor coupled to the memory, wherein the computer-executable instructions cause the processor to be configured to:

determine a downmixed audio signal of a current frame;

determine a first residual audio signal of the current frame;

determine an energy relationship between the downmixed audio signal of the current frame and the first residual audio signal of the current frame;

determine an initial encoding mode of the current frame based on the energy relationship;

obtain indication information of a first encoding mode of the first residual audio signal of the current frame, wherein the first encoding mode indicates whether to encode the first residual audio signal or to not encode the first residual audio signal, and wherein the indication information comprises at least one of an encoding status of one or more second residual audio signals of one or more first previous frames of the current frame, a first value of an updating manner flag for a long-term smooth parameter of a first stereo audio signal of the current frame, or a second value of a status change parameter of the first stereo audio signal relative to one or more second stereo audio signals of the one or more first previous frames;

determine the first encoding mode based on the indication information and the initial encoding mode; and selectively perform encoding of the first residual audio signal according to the first encoding mode.

11. The apparatus of claim 10, wherein the encoding status indicates at least one of:

a first quantity of first consecutive frames previous to the current frame, wherein residual audio signals of all of the first consecutive frames are encoded;

a second quantity of second consecutive frames previous to the current frame, wherein residual audio signals of all of the second consecutive frames are not encoded; or encoding modes of residual audio signals of N frames previous to the current frame, wherein the N frames are consecutive in a time domain and wherein N is a positive integer.

12. The apparatus of claim 11, wherein the encoding status indicates the encoding modes, and wherein the computer-executable instructions further cause the processor to be configured to determine that the first encoding mode is the initial encoding mode when the initial encoding mode is the same as a second encoding mode of the one or more second residual audio signals.

13. The apparatus of claim 11, wherein the indication information comprises the encoding status or the first value, wherein the encoding status indicates the first quantity and the encoding modes, wherein the computer-executable instructions further cause the processor to be configured to determine that the first encoding mode is a second encoding mode of the one or more second residual audio signals when the initial encoding mode is different from the second encoding mode, wherein the second encoding mode indicates to encode the one or more second residual audio signals and that a first condition is met, and wherein the first condition comprises at least one of:

the first quantity is less than a first threshold;

the first value is zero; or the second encoding mode is not modified.

14. The apparatus of claim 11, wherein the indication information comprises the encoding status or the second value, wherein the encoding status indicates the second quantity and the encoding modes, wherein the computer-executable instructions further cause the processor to be configured to determine that the first encoding mode is a second encoding mode of the one or more second residual audio signals when the initial encoding mode is different from the second mode, wherein the second encoding mode indicates not to encode the one or more second residual audio signals and that a second condition is met, and wherein the second condition comprises at least one of:

the second quantity is less than a first threshold; or the second value is greater than or equal to a second threshold and less than or equal to a third threshold.

15. The apparatus of claim 11, wherein the computer-executable instructions further cause the processor to be configured to modify, subsequent to determining the first encoding mode, the first encoding mode based on the indication information.

16. The apparatus of claim 15, wherein the encoding status indicates the encoding modes, and wherein the computer-executable instructions further cause the processor to be configured to determine that the first encoding mode indicates to encode the first residual audio signal when the first encoding mode is different from a second encoding mode of the one or more second residual audio signals and the second encoding mode of the one or more second residual audio signals is not modified.

17. The apparatus of claim 10, wherein the one or more first previous frames are M frames previous to the current frame and are consecutive in a time domain, wherein the second value comprises a first ratio of a first energy of the first stereo audio signal to a second energy of the second stereo audio signal, and wherein M is a positive integer; or wherein the one or more first previous frames are S frames previous to the current frame and are consecutive in a time domain, wherein the second value comprises a second ratio of a first amplitude of the first stereo audio signal to a second amplitude of the second stereo audio signal, and wherein S is a positive integer.

18. The apparatus of claim 10, wherein the initial encoding mode is different than the first encoding mode.

19. A computer program product comprising computer-executable instructions for storage on a non-transitory computer-readable storage medium that, when executed by a processor, cause an apparatus to:

determine a downmixed audio signal of a current frame;

determine a first residual audio signal of the current frame;

determine an energy relationship between the downmixed audio signal of the current frame and the first residual audio signal of the current frame;

determine an initial encoding mode of the current frame based on the energy relationship;

obtain indication information of a first encoding mode of the first residual audio signal of the current frame, wherein the encoding mode indicates whether to encode the first residual audio signal of the current frame or to not encode the first residual audio signal of the current frame, and wherein the indication information comprises at least one of an encoding status of one or more second residual audio signals of one or more first previous frames of the current frame, a first value of an updating manner flag for a long-term smooth parameter of a first stereo audio signal of the current frame, or a second value of a status change parameter of the first stereo audio signal relative to one or more second stereo audio signals of the one or more first previous frames; and determine the first encoding mode based on the indication information and the initial encoding mode; and selectively perform encoding of the first residual audio signal according to the first encoding mode.

20. The computer program product of claim 19, wherein the encoding status indicates at least one of:

a first quantity of first consecutive frames previous to the current frame, wherein residual audio signals of all of the first consecutive frames are encoded;

a second quantity of second consecutive frames previous to the current frame, wherein residual audio signals of all of the second consecutive frames are not encoded; or encoding modes of residual audio signals of N frames previous to the current frame, wherein the N frames are consecutive in a time domain, and wherein N is a positive integer.

* * * * *